US010511076B2

(12) United States Patent
Laighton et al.

(10) Patent No.: US 10,511,076 B2
(45) Date of Patent: Dec. 17, 2019

(54) RF COUPLER INCLUDING VERTICALLY STACKED COUPLING SECTIONS HAVING CONDUCTIVE LAYERS DISPOSED BETWEEN THE COUPLING SECTIONS AND THE COUPLER INCLUDING A SURROUNDING ELECTRIC SHIELD

(71) Applicant: Raytheon Company, Waltham, MA (US)

(72) Inventors: Christopher M. Laighton, Boxborough, MA (US); Susan C. Trulli, Lexington, MA (US); Elicia K. Harper, Chelsea, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 15/693,743

(22) Filed: Sep. 1, 2017

(65) Prior Publication Data

US 2019/0074567 A1 Mar. 7, 2019

(51) Int. Cl.
*H01P 5/18* (2006.01)

(52) U.S. Cl.
CPC ..... *H01P 5/184* (2013.01); *H01P 5/185* (2013.01); *H01P 5/187* (2013.01)

(58) Field of Classification Search
CPC ..... H01P 5/187; H01P 5/184; H01P 5/185; H01P 5/18
USPC ..... 333/116
See application file for complete search history.

(56) References Cited

U.S. PATENT DOCUMENTS

| | | | | |
|---|---|---|---|---|
| 3,506,932 | A | 4/1970 | Beurrier | |
| 4,930,215 | A * | 6/1990 | Roche et al. | H01P 3/085 29/830 |
| 5,369,379 | A * | 11/1994 | Fujiki | H01P 5/185 333/116 |
| 5,576,669 | A | 11/1996 | Ruelke | |
| 5,742,210 | A | 4/1998 | Chaturvedi et al. | |
| 6,208,220 | B1 * | 3/2001 | Logothetis | H01P 5/185 333/116 |

OTHER PUBLICATIONS

Raghu K. Settaluri, A. Weisshaar, C. Lim, Vijai K. Tripathi, Design of Compact Mutilevel Folded-Line RF Couplers, IEEE Transactions on Microwave Theory and Techniques, vol. 47, No. 12, Dec. 1999, pp. 2331-2339 (9 pages).

(Continued)

*Primary Examiner* — Benny T Lee
(74) *Attorney, Agent, or Firm* — Daly, Crowley, Mofford & Durkee, LLP

(57) ABSTRACT

An RF coupler having: a pair of input ports; a pair of output ports; and a coupling region for coupling: a portion of an input signal at a first one of the input ports to first of the pair of output ports and another portion of the input signal fed to the first one of the input ports a second one of the output ports; and one portion of an input signal fed to a second one of the input ports to the second of the pair of output ports and another portion of the input signals fed to the second one of the input ports to the second one of the output ports. The coupling region comprises a plurality of serially connected, vertically stacked, coupling sections. Each one of a plurality of electrically conductive layers is disposed between a pair of the vertically stacked coupling sections.

13 Claims, 43 Drawing Sheets

(56) References Cited

OTHER PUBLICATIONS

Raghu K. Settaluri, A. Weisshaar, C. Lim, Vijai K. Tripathi, Compact Multi-Level Folded Coupled Line RF Couplers, IEEE MIT-S Digest, 1999, pp. 1721-1724 (4 pages).
Notification of Transmittal of the International Search Report and Written Opinion of the ISA dated Oct. 29, 2018 for International Application No. PCT/US2018/043858; 1 Page.
International Search Report dated Oct. 29, 2018 for International Application No. PCT/US2018/043858; 5 Pages.
Written Opinion of the ISA dated Oct. 29, 2018 for International Application No. PCT/US2018/043858; 10 Pages.

* cited by examiner

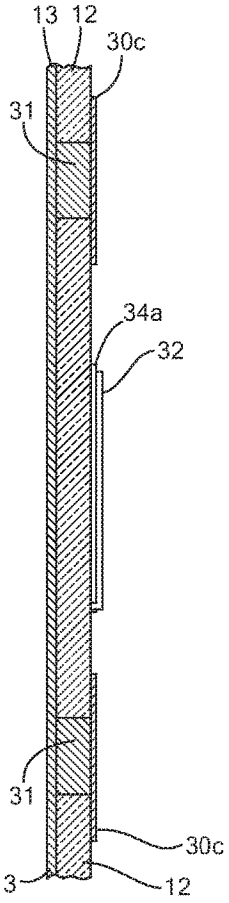
FIG. 3B''
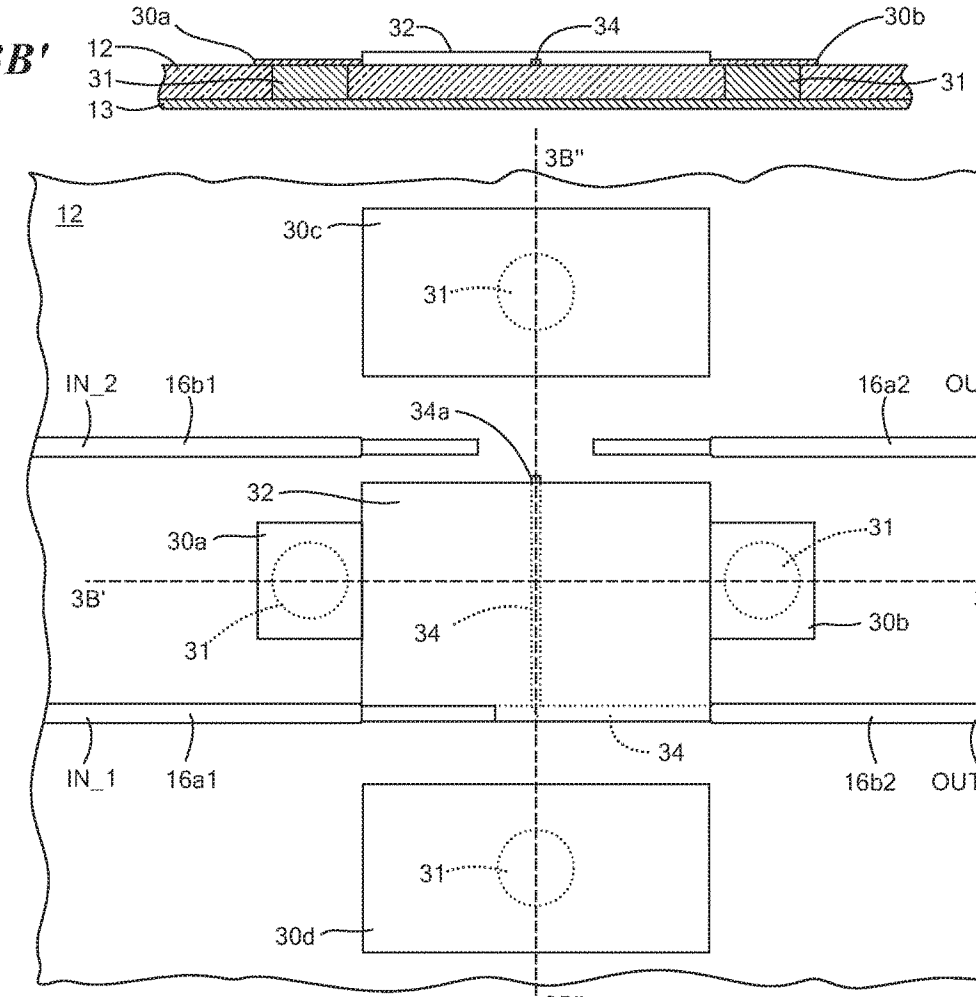
FIG. 3B
FIG. 3B'

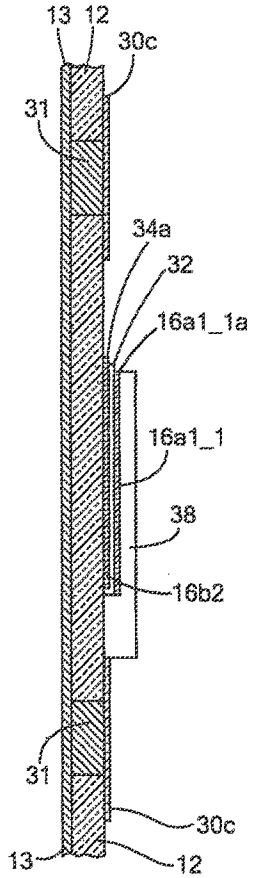
FIG. 3D''
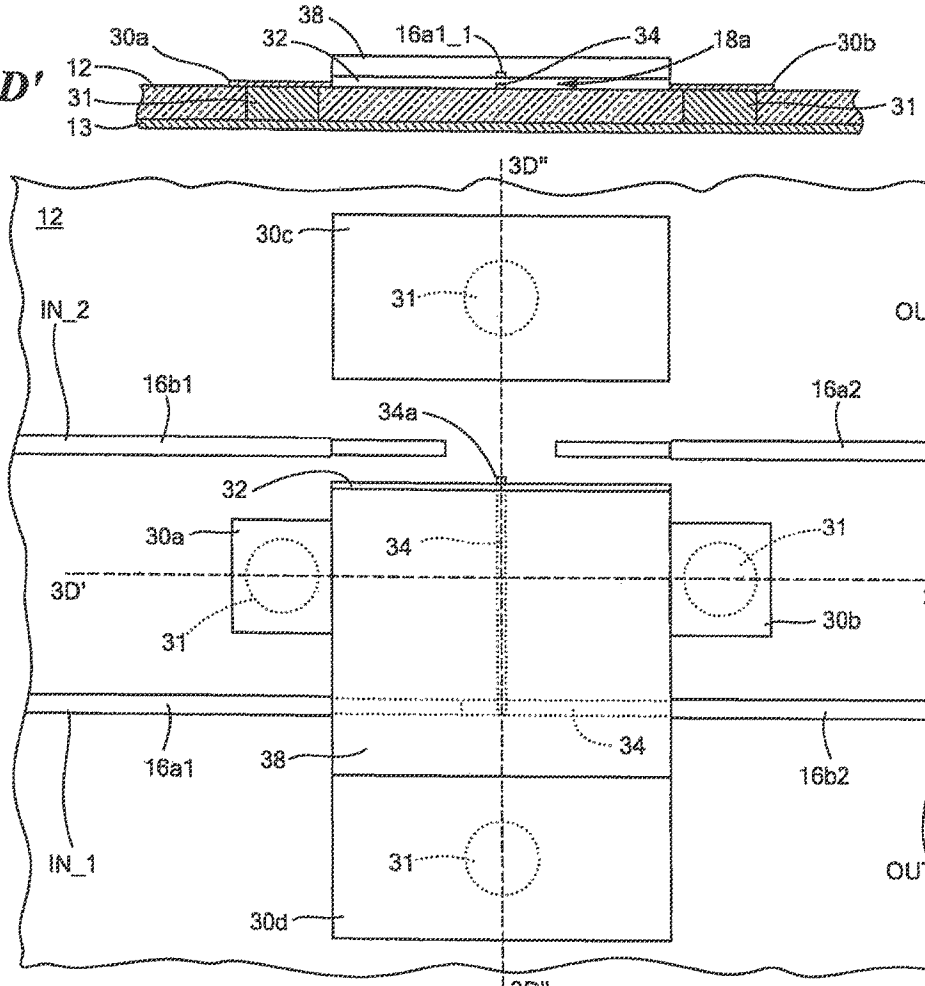
FIG. 3D
FIG. 3D'

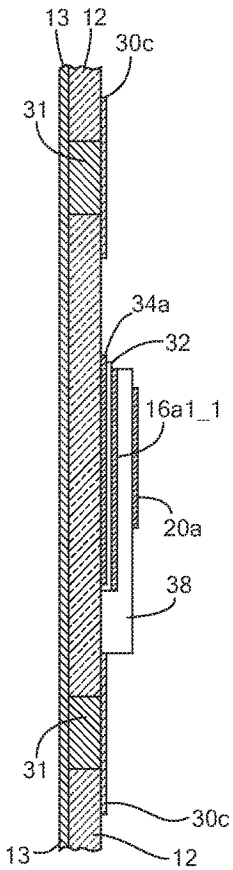
FIG. 3E''
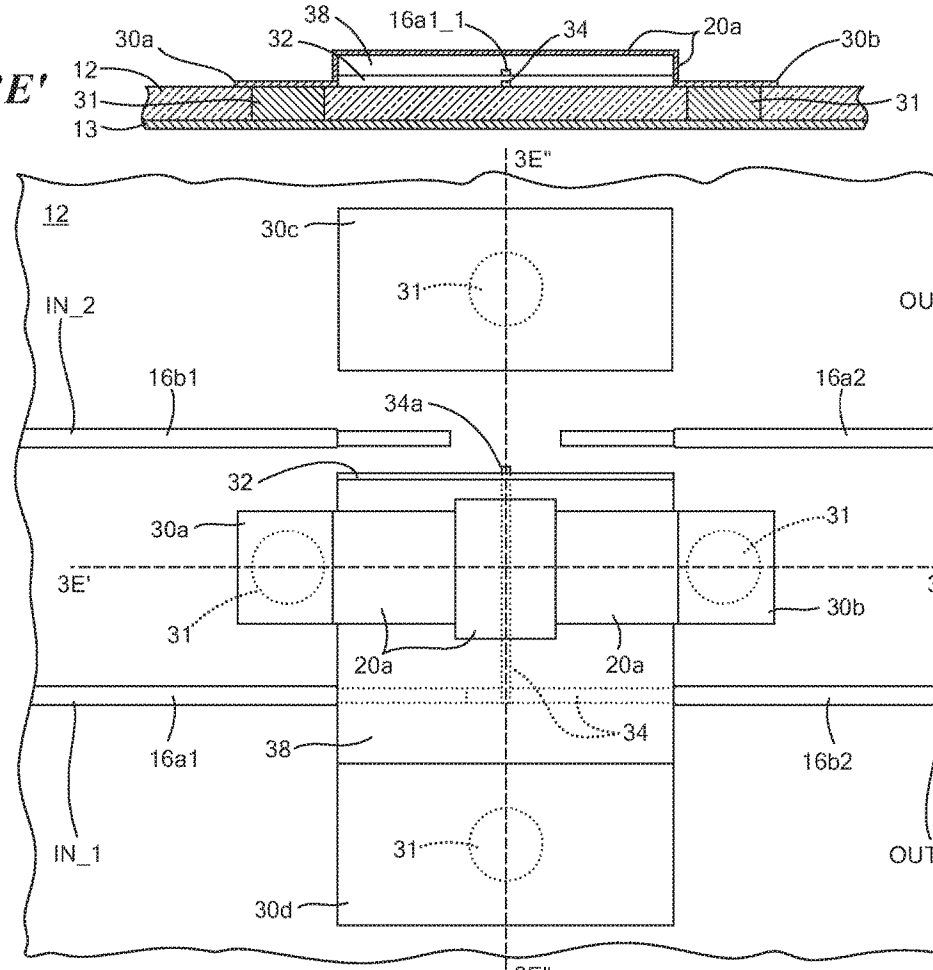
FIG. 3E
FIG. 3E'

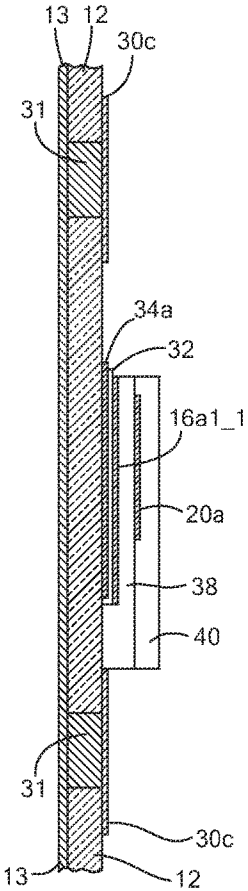
FIG. 3F''
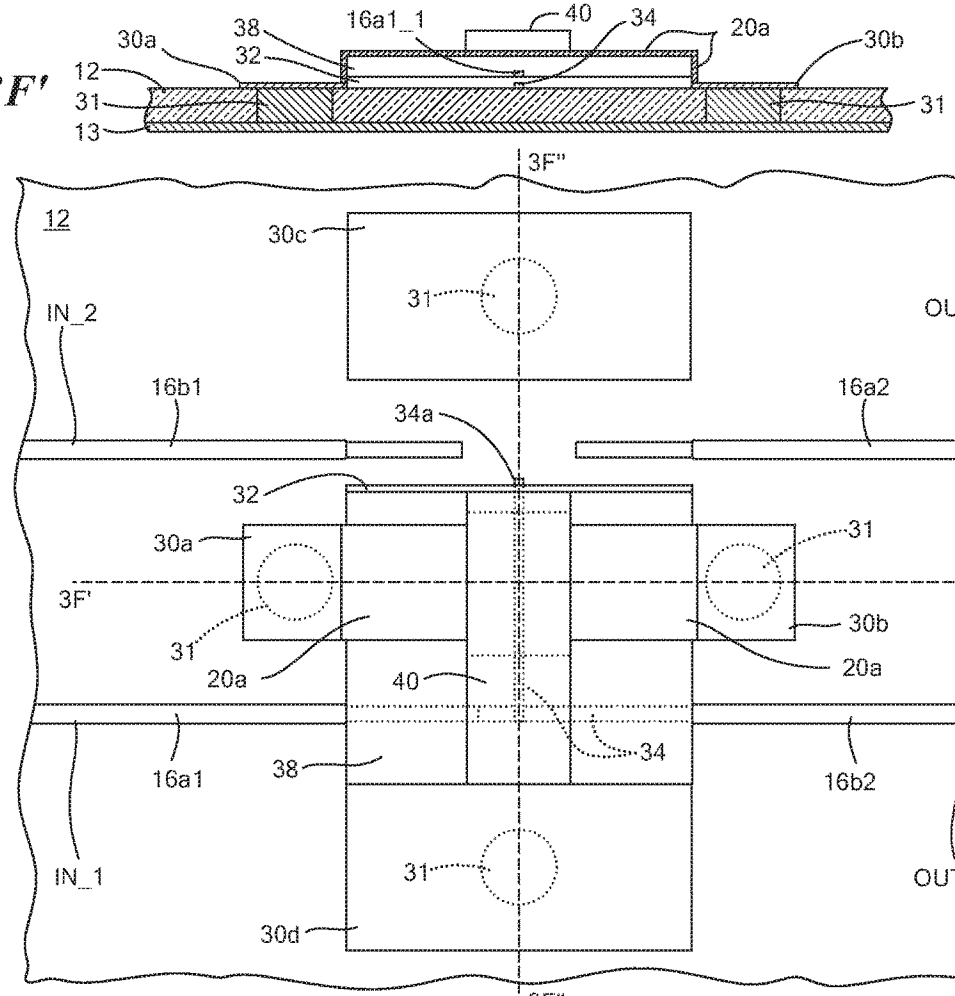
FIG. 3F
FIG. 3F'

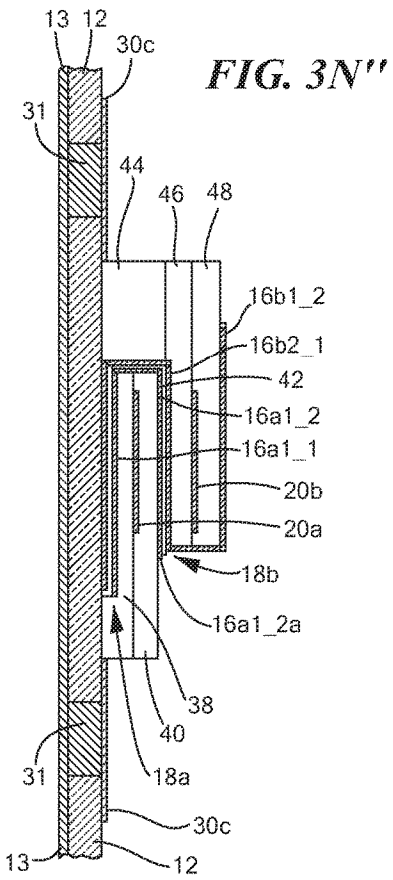
FIG. 3N'
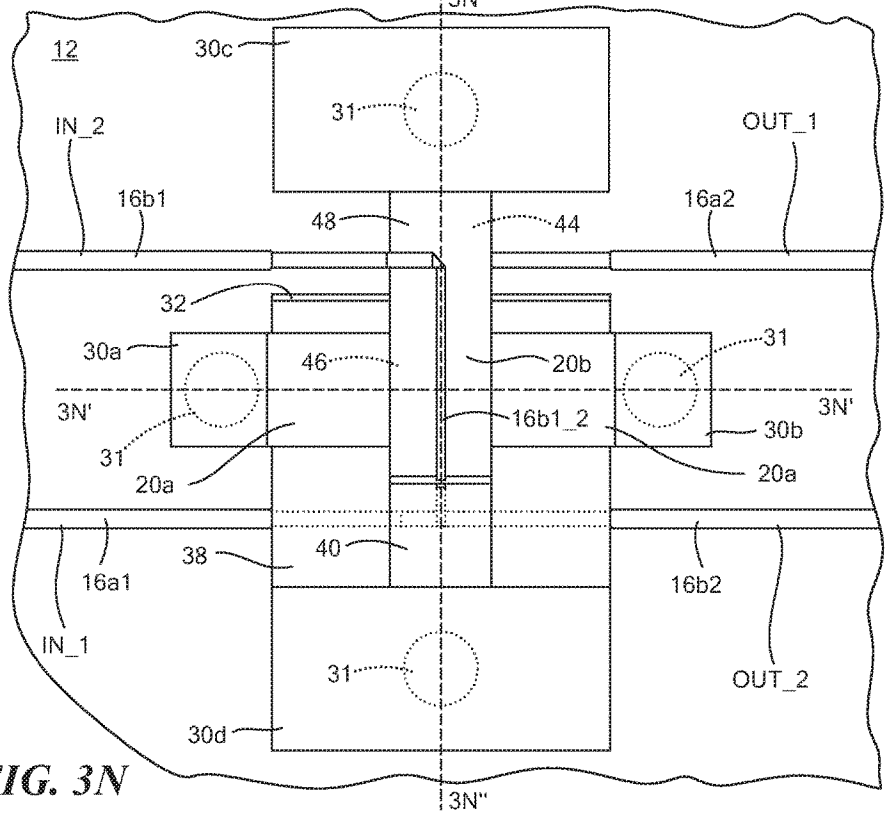
FIG. 3N
FIG. 3N''

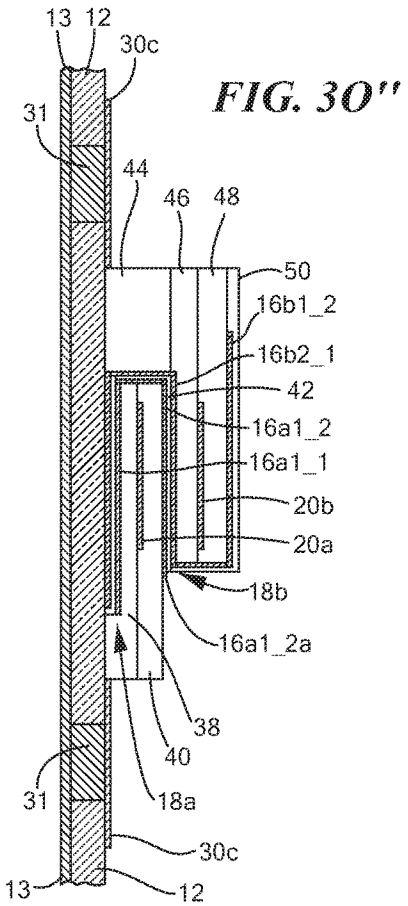
FIG. 30''
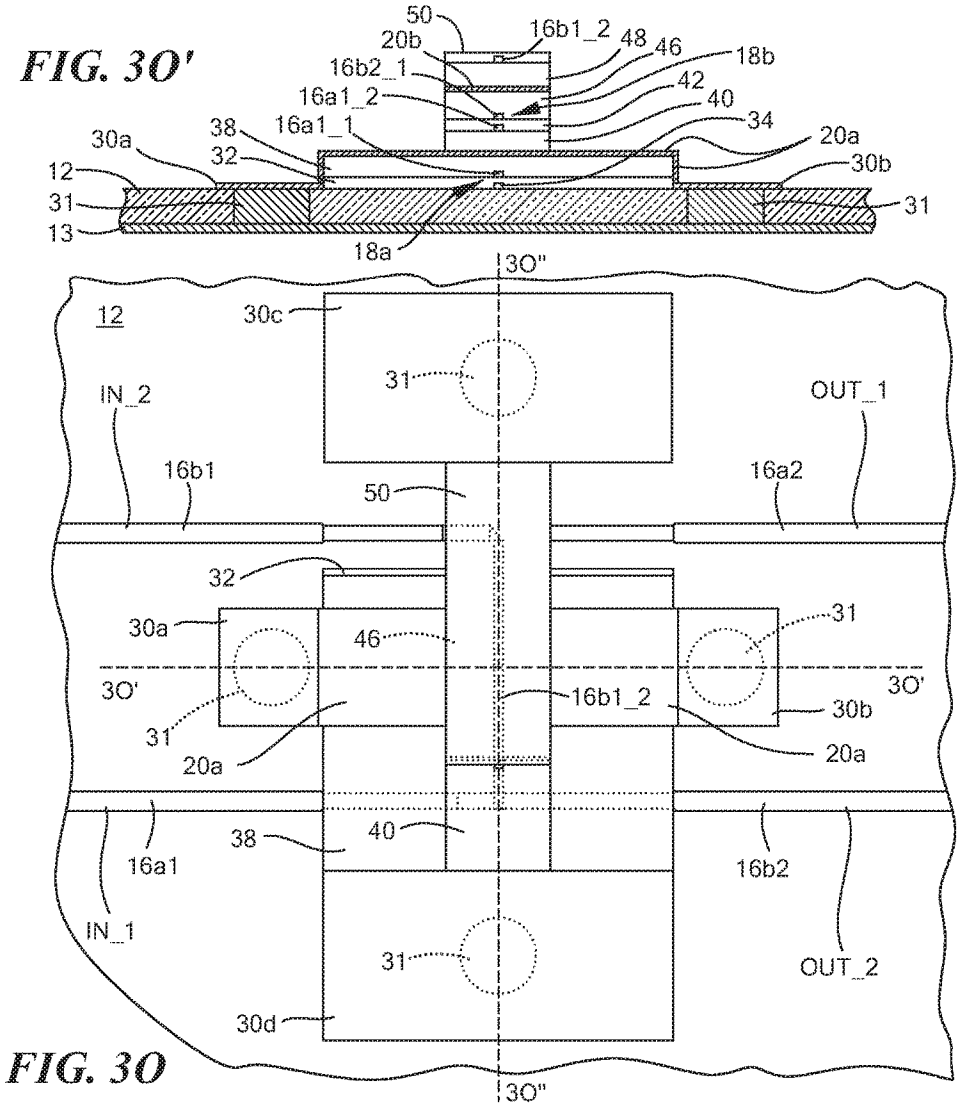
FIG. 30'
FIG. 30

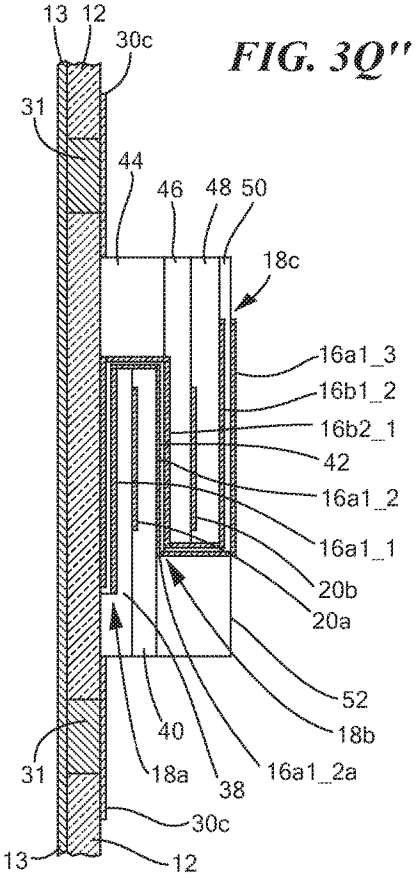
FIG. 3Q''
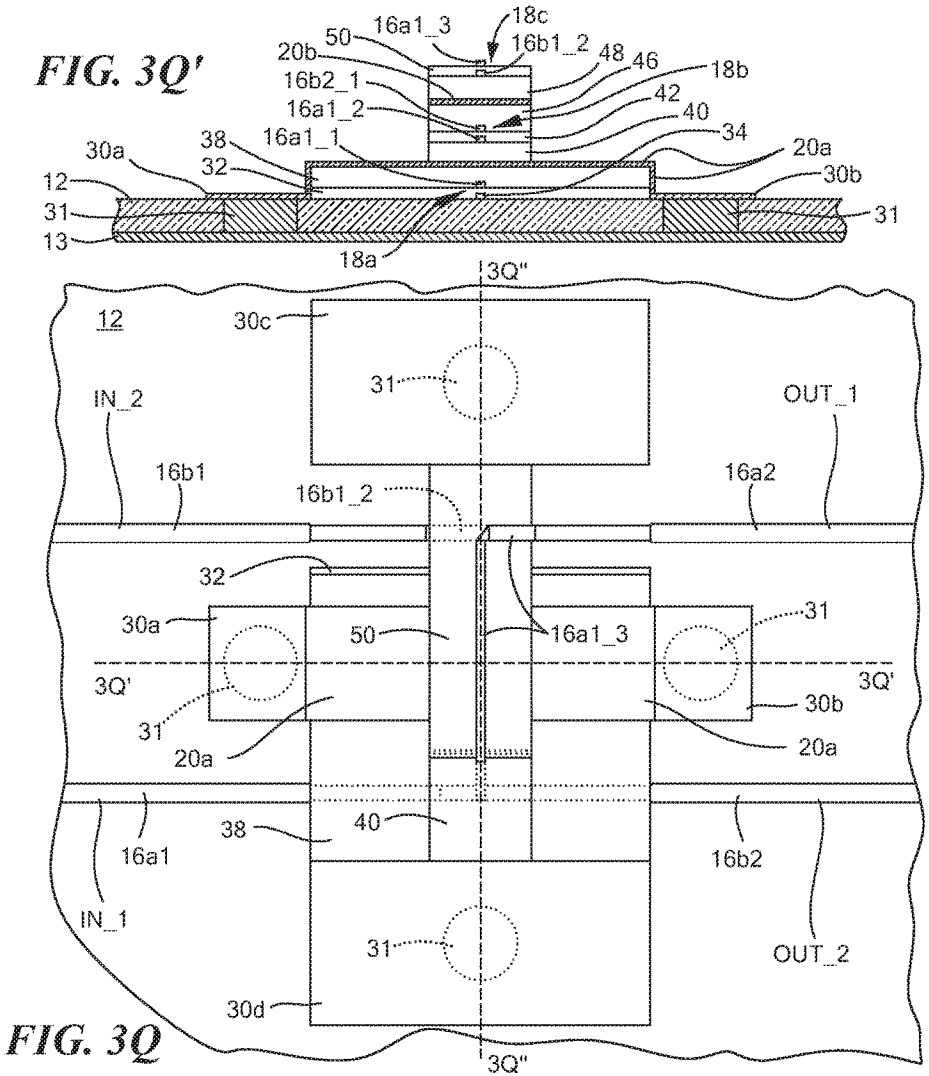
FIG. 3Q'
FIG. 3Q

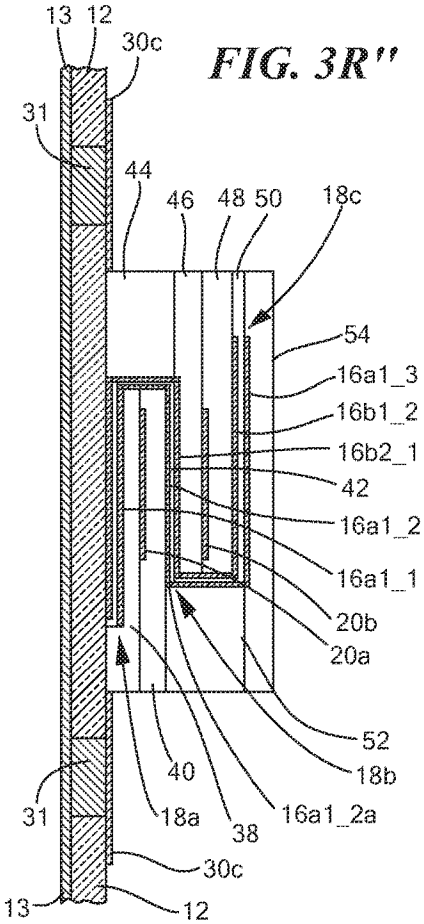
FIG. 3R''
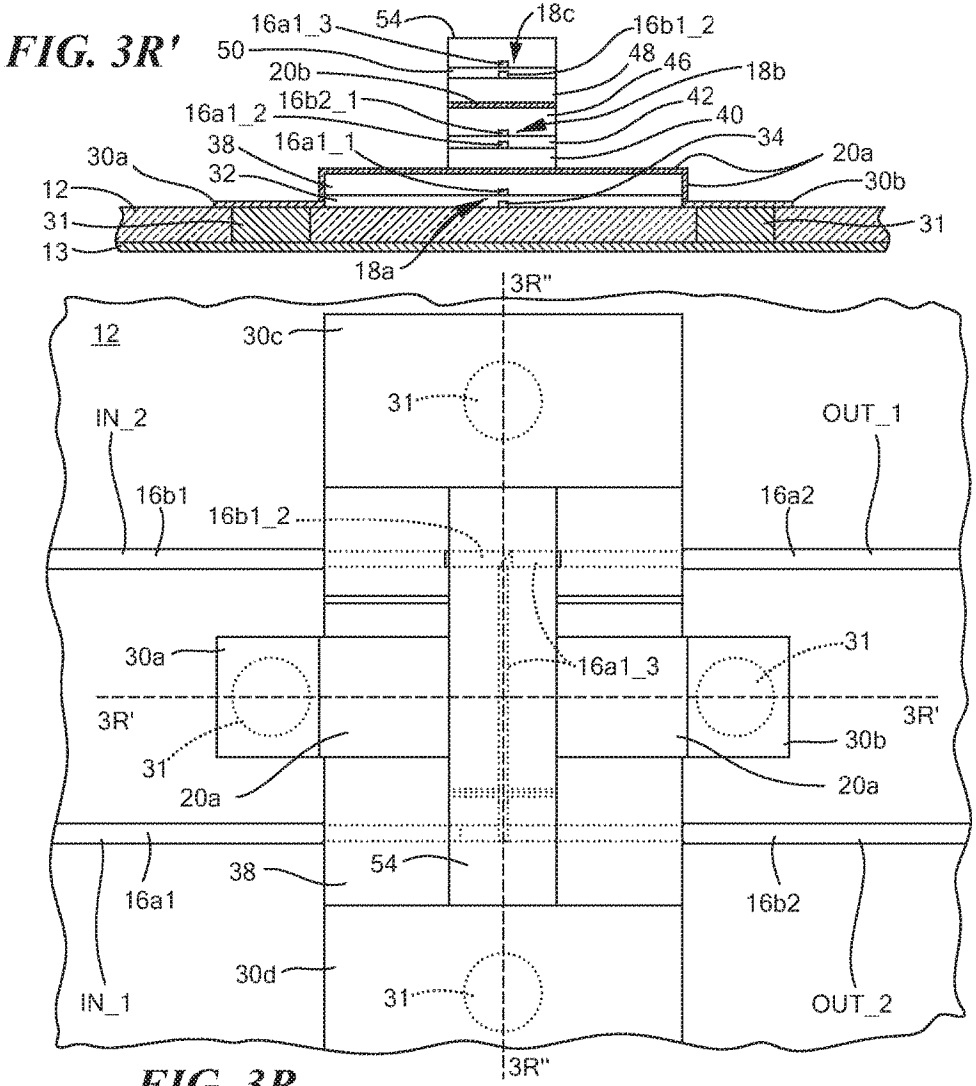
FIG. 3R'
FIG. 3R

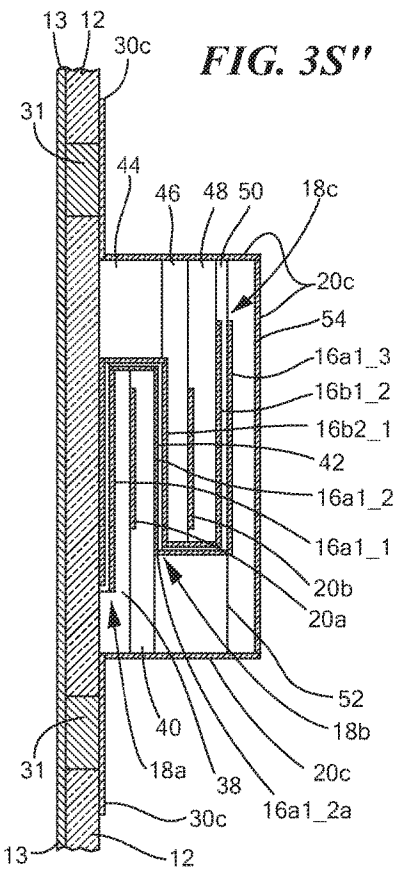
FIG. 3S''
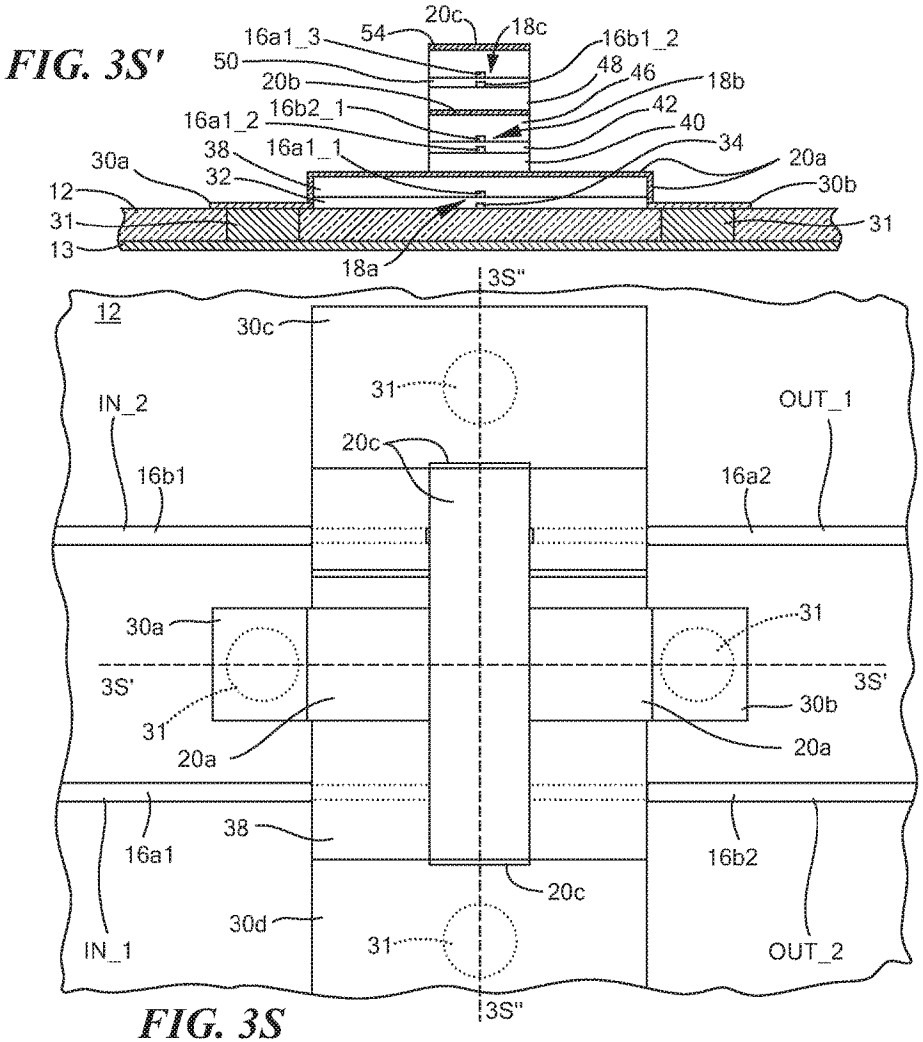
FIG. 3S'
FIG. 3S

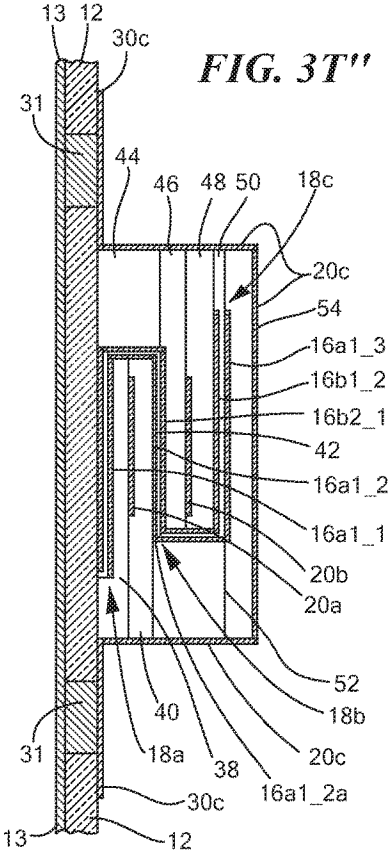
FIG. 3T''
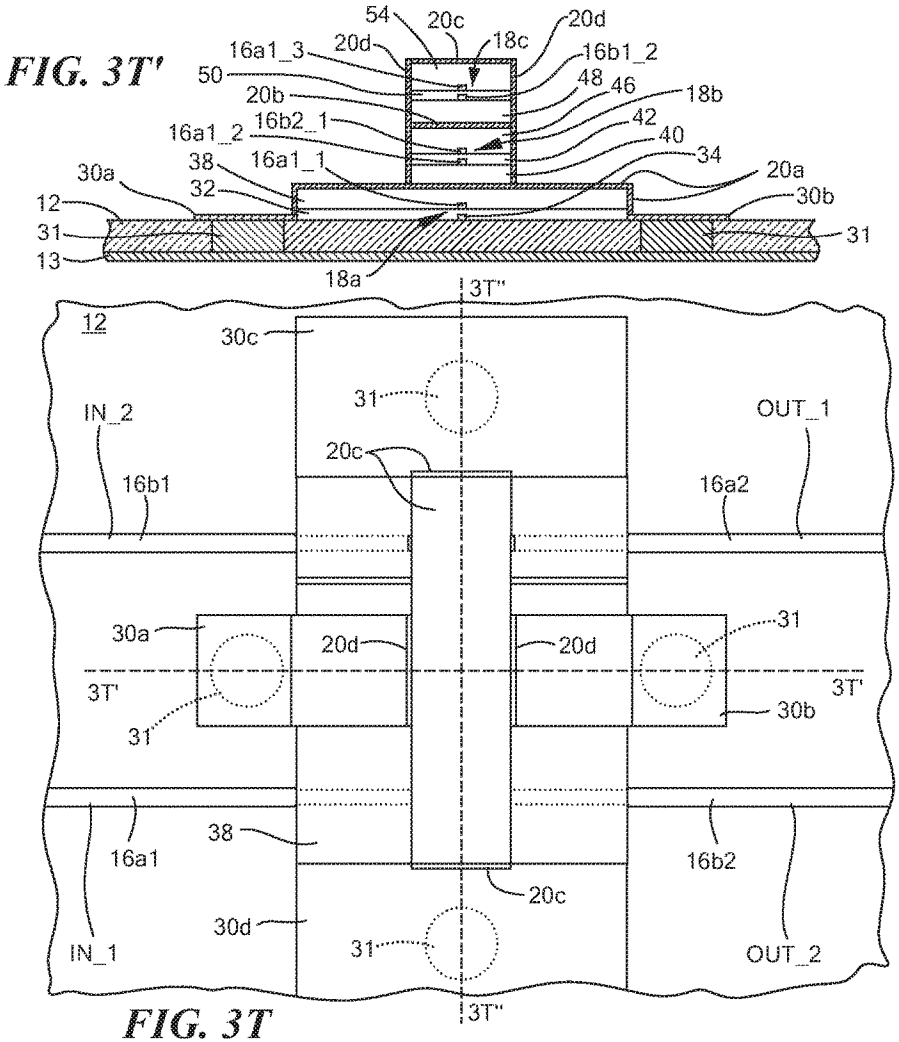
FIG. 3T'
FIG. 3T

RF COUPLER INCLUDING VERTICALLY STACKED COUPLING SECTIONS HAVING CONDUCTIVE LAYERS DISPOSED BETWEEN THE COUPLING SECTIONS AND THE COUPLER INCLUDING A SURROUNDING ELECTRIC SHIELD

TECHNICAL FIELD

This disclosure relates generally to radio frequency (RF) couplers and more particularly to compact RF couplers.

BACKGROUND

As is known in the art, Radio Frequency (RF) couplers are four port or input/output RF devices and have a wide range of applications. One type of coupler is a quadrature coupler shown in FIGS. 1A and 1B to include: a pair of strip conductors SC1, SC2 physically separated one from the other by a dielectric board B1 (FIG. 1B) and disposed between a pair of ground plane conductors GP1, GP2 (FIG. 1B) formed on the upper surfaces of a corresponding one of a pair of dielectric boards B2 and B3, (FIG. 2B) respectively, as shown. More particularly, each one of the a pair of strip conductors SC1, SC2 has an input port I1, I2 (FIG. 1A) respectively, coupled to a pair of output ports O1, O2, (FIG. 1A) respectively, through an electromagnetic coupling region CR (FIGS. 1A, 1B). The electromagnetic coupling region CR is a region where a portion of the strip conductors SR1 SR2, in this configuration, vertically overlay one another and are separated by a vertical gap G (FIG. 1B). It is in this electromagnetic coupling region CR that radio frequency energy passing through the strip conductors SC1, SC2 is coupled between the pair of strip conductors SC1, SC2 by electromagnetically passing through the gap G. It is noted that the opposing ends of strip conductor SC1 are connected to the input port I1 (FIG. 1A) and the output port O1 (FIG. 1A) respectively, while the opposing ends of the strip conductor SC 2 are connected to the input port I2 (FIG. 1A) and the output port O2 (FIG. 1A), respectively as shown. More particularly, one portion of an input signal fed input port I1 passes to output port O1 and another portion of the input signal at input port I1 is coupled by the electromagnetic coupling region CR to both output ports O1 and O2; output port O2 typically being connected to a matched load, not shown. The above described coupler is sometimes referred to as an overlay coupler; another type of coupler is a broadside coupler (FIGS. 1C and 1D) where instead of the electromagnetic coupling region CR being a pair of overlaying strip conductors, as in FIGS. 1A and 1B, the pair of strip conductors SC1, SC2 (FIGS. 1C and 1D) where instead of the electromagnetic coupling region CR being a pair of overlaying strip conductors, as in FIGS. 1A and 1B, the pair of strip conductors SC1, SC2 (FIGS. 1C and 1D) are on the same surface of a common dielectric board Ba (FIG. 1D) and the portions of the strip conductors SC1, SC2 in the electromagnetic coupling region CR are in a side by side arrangement and are separated by a horizontal gap G (FIGS. 1C and 1D).Thus, while here again the pair of strip conductors SC1, SC2 are physically separated one from the other by a dielectric boards Ba and B1 (FIGS. 1C and 1D), radio frequency energy is electromagnetically coupled between the strip conductors SC1, SC2 by electromagnet energy passing between them through the gap G. Thus, here again, it is in this electromagnetic coupling region CR that radio frequency energy passing through the strip conductors SC1, SC2 is electromagnetically coupled between the pair of strip conductors SC1, SC2.

It is desirable that the surface area occupied by the coupler be minimized. Several couplers are discussed in the following papers: Design of Compact Multilevel Folded-Line RF Couplers by Settaluri et al., IEEE TRANSACTIONS ON MICROWAVE THEORY AND TECHNIQUES, VOL. 47, NO. 12, DECEMBER 1999, pages 2331-2339; and COMPACT MULTI-LEVEL FOLDED COUPLED LINE RF COUPLERS, Settaluri et al., 1999 IEEE MTT-S Digest pages 1721-1724.

SUMMARY OF THE INVENTION

In accordance with the present disclosure, an RF coupler is provided, comprising: a pair of dielectrically separated strip conductors; and a coupling section. The coupling section includes: a plurality of serially connected, vertically stacked, coupling sections, each one of the coupling sections comprising adjacent portions of the pair of strip conductors separated by a dielectric gap, the gap forming an electromagnetic coupling region between the adjacent portions of the pair of strip conductors. The coupler includes a plurality of electrically conductive layers, each one of the electrically conductive layers being disposed between a corresponding pair of the vertically stacked coupling sections.

In one embodiment, the adjacent portions of the pair of strip conductors in each one of the coupling sections are disposed in an overlaying relationship in a vertical plane.

In one embodiment, the adjacent portions of the pair of strip conductors in each one of the coupling sections are disposed in a side-by-side relationship in a horizontal plane.

In one embodiment, an RF coupler is provided, comprising: a pair of dielectrically separated strip conductors; and a coupling section. The coupling section includes: a plurality of serially connected, vertically stacked, coupling sections, each one of the coupling sections comprising adjacent portions of the pair of strip conductors, disposed in an overlaying relationship in a vertical plane, and separated by a dielectric gap, the gap forming an electromagnetic coupling region between the adjacent portions of the pair of strip conductors.

In one embodiment, each one of the coupling sections includes a pair of strip conductors separated by a dielectric, a first one of the pair of strip conductors having one end coupled to the first one of the input ports and an opposite end coupled to the second output port, and a second one of the pair of strip conductors having one end coupled to the second input port and an opposite end coupled to the first output port.

In one embodiment, the one end of one of the second one of the pair of strip conductors is connected to the opposite end of the first one of the pair of strip conductors.

In one embodiment, the coupler includes a plurality of horizontally disposed dielectric layers, each one of the dielectric layers being disposed on a corresponding one of the strip conductors of the serially connected, vertically stacked, coupling sections.

In one embodiment, the coupler includes a plurality of electrically conductive layers, each one of the electrically conductive layers being disposed between a corresponding pair of the coupling sections.

In one embodiment, the coupler includes an additional electrically conductive layer disposed over an upper most one of the serially connected, vertically stacked, coupling sections.

In one embodiment, the plurality of connected electrically conductive layers is disposed between a corresponding pair of the dielectric layers, the electrically conductive layers being disposed over an upper most one of the serially connected, vertically stacked, coupling sections, and the sides of the electrically conductive layers being disposed on side of the vertically stacked, coupling sections.

The details of one or more embodiments of the disclosure are set forth in the accompanying drawings and the description below. Other features, objects, and advantages of the disclosure will be apparent from the description and drawings, and from the claims.

BRIEF DESCRIPTION OF THE DRAWINGS

FIGS. 3A-3T are plan, cross sectional and perspective views of the coupler of FIG. 2A at various stages in the fabrication thereof wherein FIGS. 3A-3T are plan views; 3A'-3T' are cross sectional views taken along lines 3A'-3T' in FIGS. 3A-3T, respectively; FIGS. 3B'"-3D'", 3G'"-3K'", 3N'", 3P'"-3T'" are perspective views of a portions of the coupler;

FIG. 5A being a plan view, FIG. 5B being a cross sectional view, such cross section being taken along line 5B-5B in FIG. 5A, FIG. 5C being a cross sectional view, such cross section being taken along line 5C-5C in FIG. 5A, FIGS. 5B' and 5C' being more cross sectional views of FIG. 5B, such cross section being taken along line 5B-5B in FIG. 5A and FIG. 5C' being a cross sectional view, such cross section being taken along line 5C-5C in FIG. 5A such that FIGS. 5B' and 5C' being useful in understanding the fabrication of the RF coupler of FIGS. 5A, 5B and 5C; and FIG. 5D being a perspective view sketch showing the arrangement of strip conductors used in the coupler; dielectric layers and shielding layers being removed for simplicity of understanding the orientation of such strip conductors.

Like reference symbols in the various drawings indicate like elements.

DETAILED DESCRIPTION OF THE INVENTION

Figure 1A:
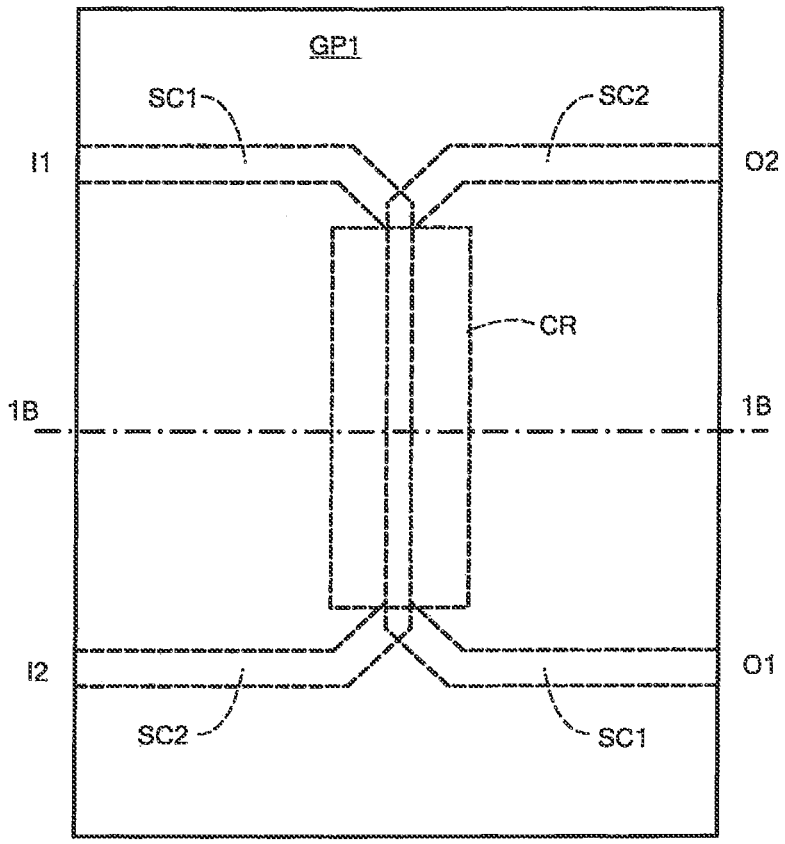
FIG. 1A PRIOR ART
FIGS. 1A and 1B are a diagrammatical plan and cross sectional sketches of a coupler according to the PRIOR ART, the cross sectional sketch of FIG. 1B being taken along line 1B-1B of FIG. 1A.
Figure 1B:
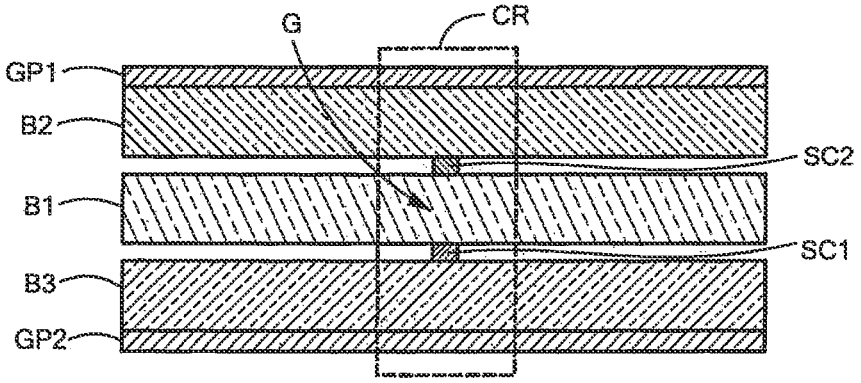
FIG. 1B PRIOR ART
Figure 1C:
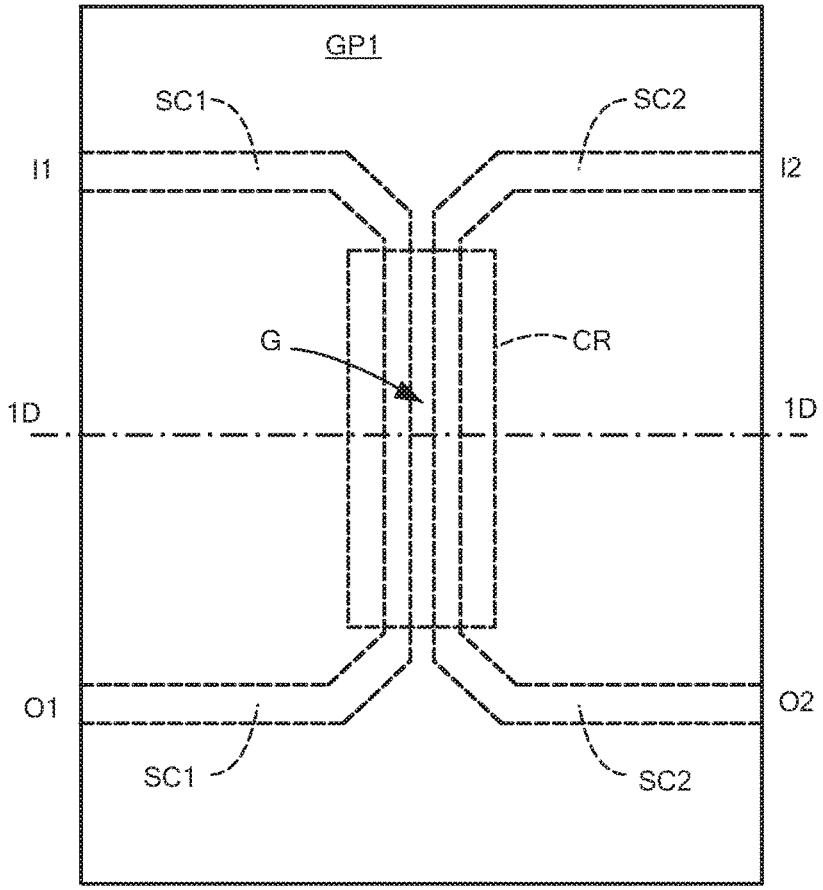
FIG. 1C PRIOR ART
FIGS. 1C and 1D are a diagrammatical plan and cross sectional sketches of a coupler according to the PRIOR ART, the cross sectional sketch of FIG. 1D being taken along line 1D-1D of FIG. 1C.
Figure 1D:
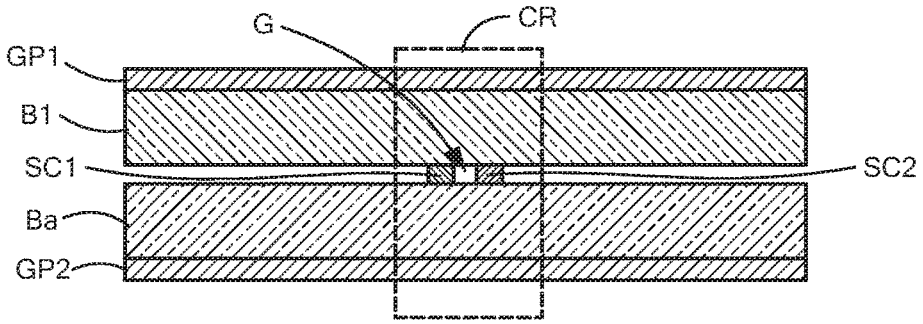
FIG. 1D PRIOR ART

Referring now to FIGS. 2A-2D, a structure 10 is shown to include a dielectric substrate 12, (FIGS. 2A-2C), having a ground plane conductor 13 (FIGS. 2B and 2C) on the bottom surface thereof and an RF coupler 14, here for example, a quadrature coupler, formed on an upper surface of the structure 10, at least in part, by additive manufacturing in a manner to be described in connection with FIGS. 3A-3T. Suffice it to say here that the structure 10 includes: (A) a pair of strip conductors 16*a*, 16*b*, (FIG.2C) which together with the ground plane conductor 13 and the dielectric substrate 12 (FIGS. 2A, 2B and 2C), provide a pair of microstrip transmission lines 16*a*, 16*b* having a pair of input ports IN_1, IN_2, respectively at one end thereof and having output ports OUT_1, OUT_2, respectively, at the opposite ends thereof, as shown (FIGS. 2A and 2D); and (B) an RF coupler 14 providing an electromagnetic coupling region 18 (FIGS. 2B and 2C) for coupling: a portion of an input signal input port IN_1 to output port OUT_1 and another portion of the input signal at input port IN_1 to output port OUT_2; and one portion of an input signal at input port IN_2 to the output port OUT_2 and another portion of the input signal at input port IN_2 to the output port OUT_1.

Figure 2B:
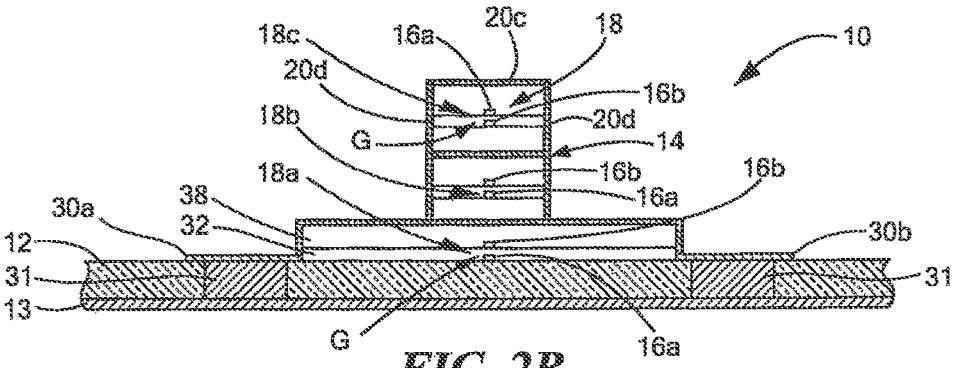
FIG. 2B is cross sectional view sketch of the coupler of FIG. 2A, such cross section being taken along line 2B-2B of FIG. 2A.
Figure 2A:
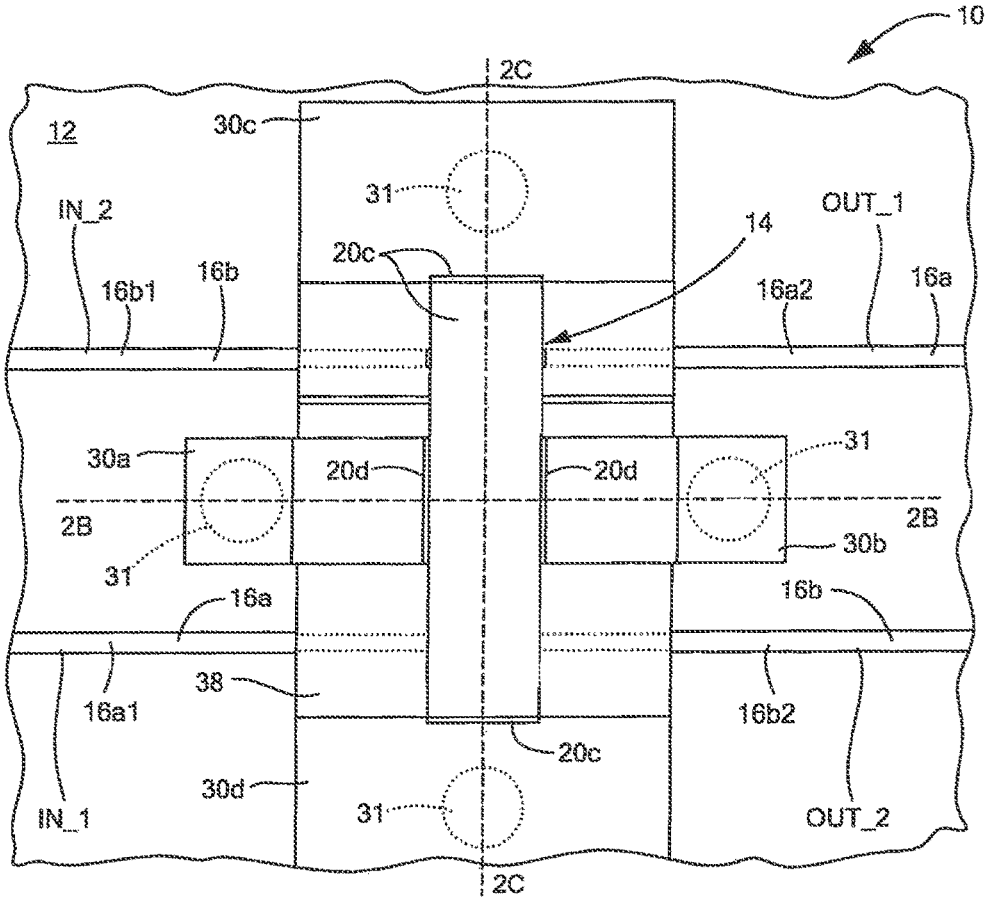
FIG. 2A is a plan view sketch of a coupler according to the disclosure.
Figure 2C:
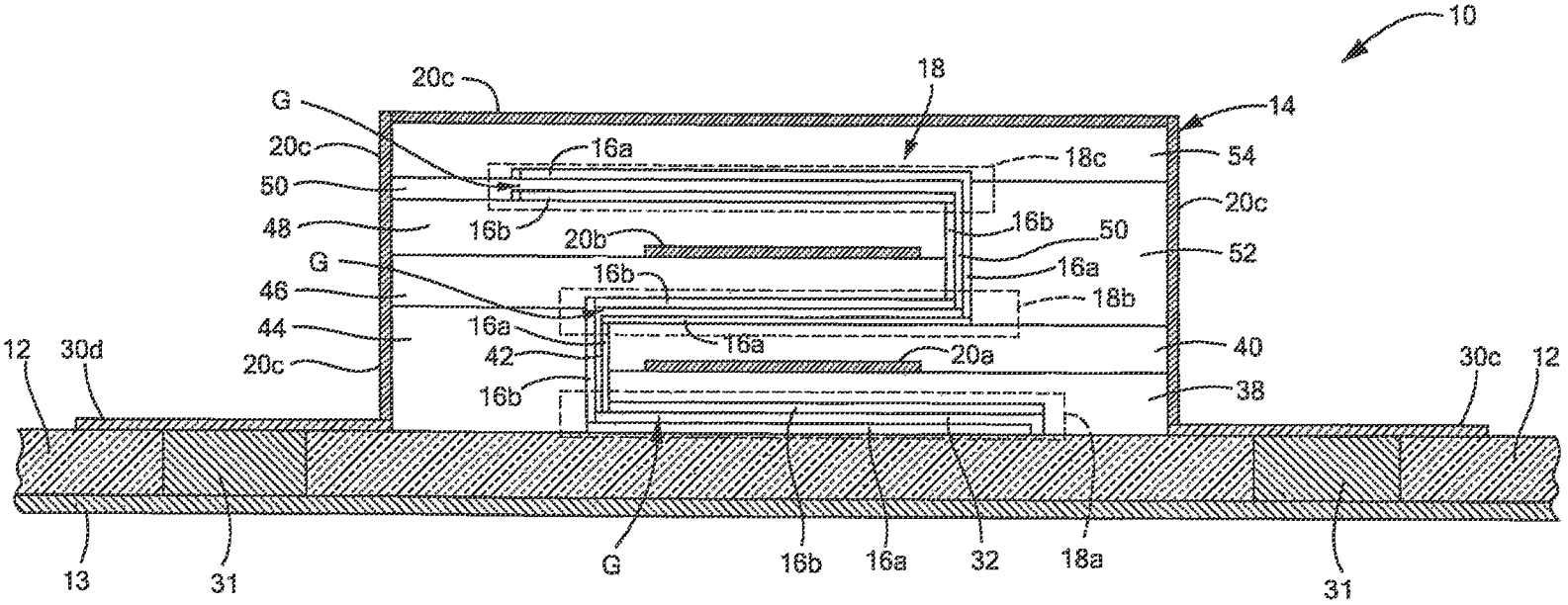
FIG. 2C is cross sectional view sketch of the coupler of FIG. 2A, such cross section being taken along line 2C-2C of FIG. 2A.
Figure 2D:
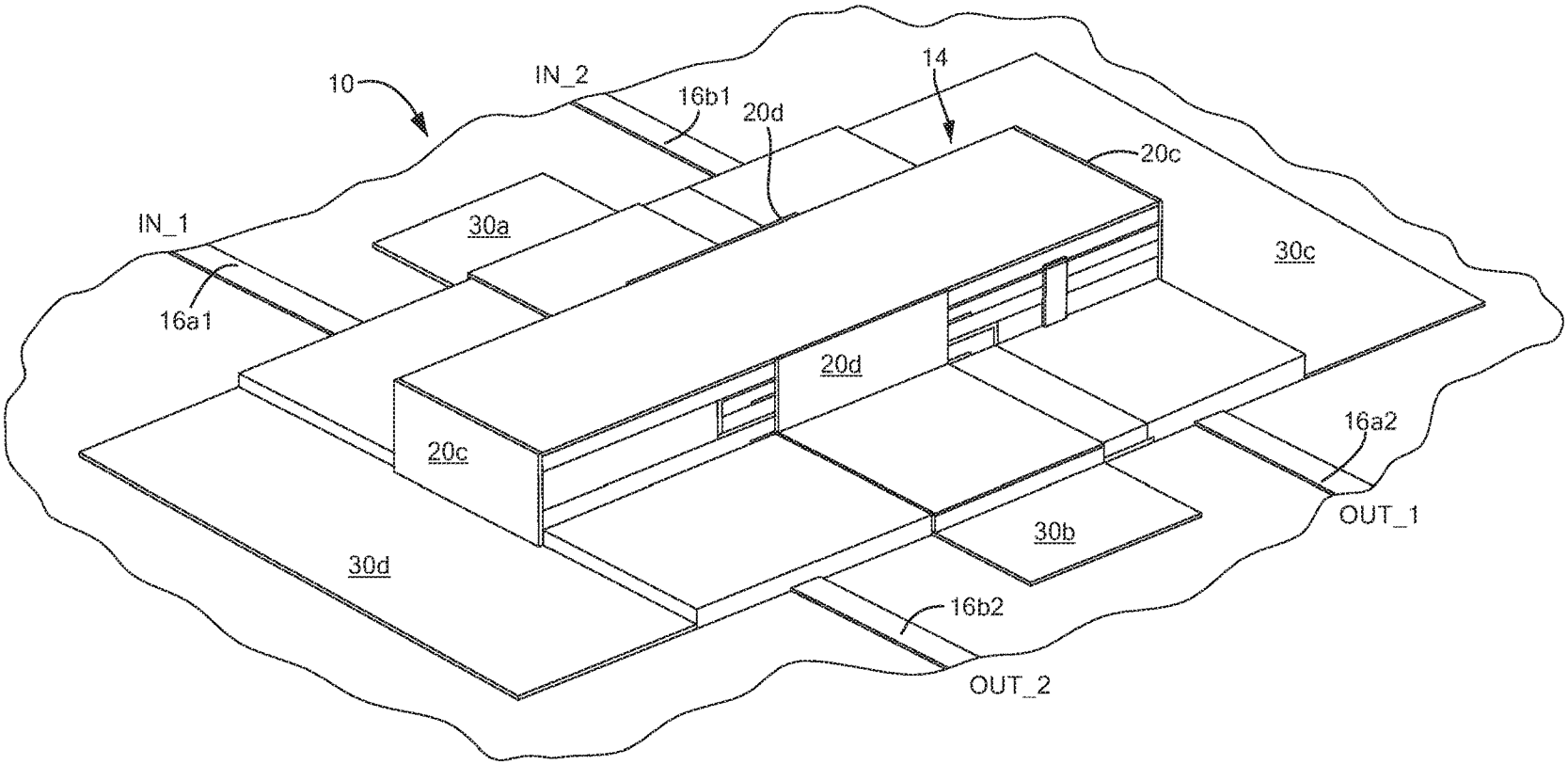
FIG. 2D is a perspective view sketch of a portion of the of the coupler of FIG. 2A.

More particularly, the electromagnetic coupling region 18 of the RF coupler 14 comprises a plurality of, here for example three, serially connected, vertically stacked, coupling sections 18*a*, 18*b*, and 18*c*; shown more clearly in FIGS. 2B and 2C. Each one of the coupling sections 18*a*, 18*b* and 18*c* includes adjacent portions of the pair of strip conductors 16*a*, 16*b*, disposed in an overlaying relationship in a vertical plane, and separated by a dielectric gap, G, (FIGS. 2B and 2C) the gap, G, forming a corresponding one of the electromagnetic coupling region 18*a*, 18*b*, 18*c* between the adjacent portions of the pair of strip conductors.

The RF coupler 14 includes two, horizontally disposed, electrically conductive layers 20*a*, 20*b*, each one of the electrically conductive layers 20*a* and 20*b* being disposed between a corresponding pair of the vertically stacked coupling sections 18*a*, 18*b* and 18*c*, as shown. More particularly, conductive layer 20*a* is disposed between coupling sections 18*a* and 18*b* and conductive layer 20*b* is disposed between coupling sections 18*b* and 18*c*. An electrically conductive layer 20*c* and 20*d* provides an upper or top cover for the RF coupler 14, and electrically conductive layer 20*d* provides sides for the RF coupler 14; it being noted that the electrically conductive layers 20*a*-20*d* are electrically interconnected one to the other and are electrically connected to conductive pads 30*a*-30*d*; such conductive pads 30*a*-30*d* being electrically connected to the ground plane conductor 13 by electrically conductive vias 31 passing vertically through the substrate 12.

More particularly, conductive layer 20*a* provides electromagnetic shielding between the coupling sections 18*a* and 18*b* and electrically conductive layer 20*b* provides electromagnetic shielding between the coupling sections 18*b* and 18*c*. The RF coupler 14 includes the additional electrically conductive layer 20*c* is disposed over an upper most one of the serially connected, vertically stacked, coupling sections 18*a*-18*c*; here coupling section 18*c*, as shown to contribute to electromagnetic shielding for the RF coupler. Electrically conductive layer 20*d* is connected to conductive layers 20*a*-20*c* to provide an electrically conductive shield on all four sides of the vertically stacked, coupling sections 18*a*-18*c*; portions of conductive layers 20*c* being on opposite sides of one another and portions of layer 20*d* being on being on opposite sides of one another. The plurality of electrically conductive layers, 20*a*-20*d* is electrically interconnected to form an electrical shield around the coupling sections 18*a*-18*c*.

It is noted that the various conductive layers 20*a*-20*d* and portions of the strip conductors 16*a*, 16*b* of the RF coupler 14 are separated (electrically insulated) one from the other by various dielectric layers 32 (FIG. 2B), 38, 40, 42, 44, 46, 48, 50, 52, and 54 (FIG. 2C), to be described below in connection with FIGS. 3A-3T.

Figure 4:
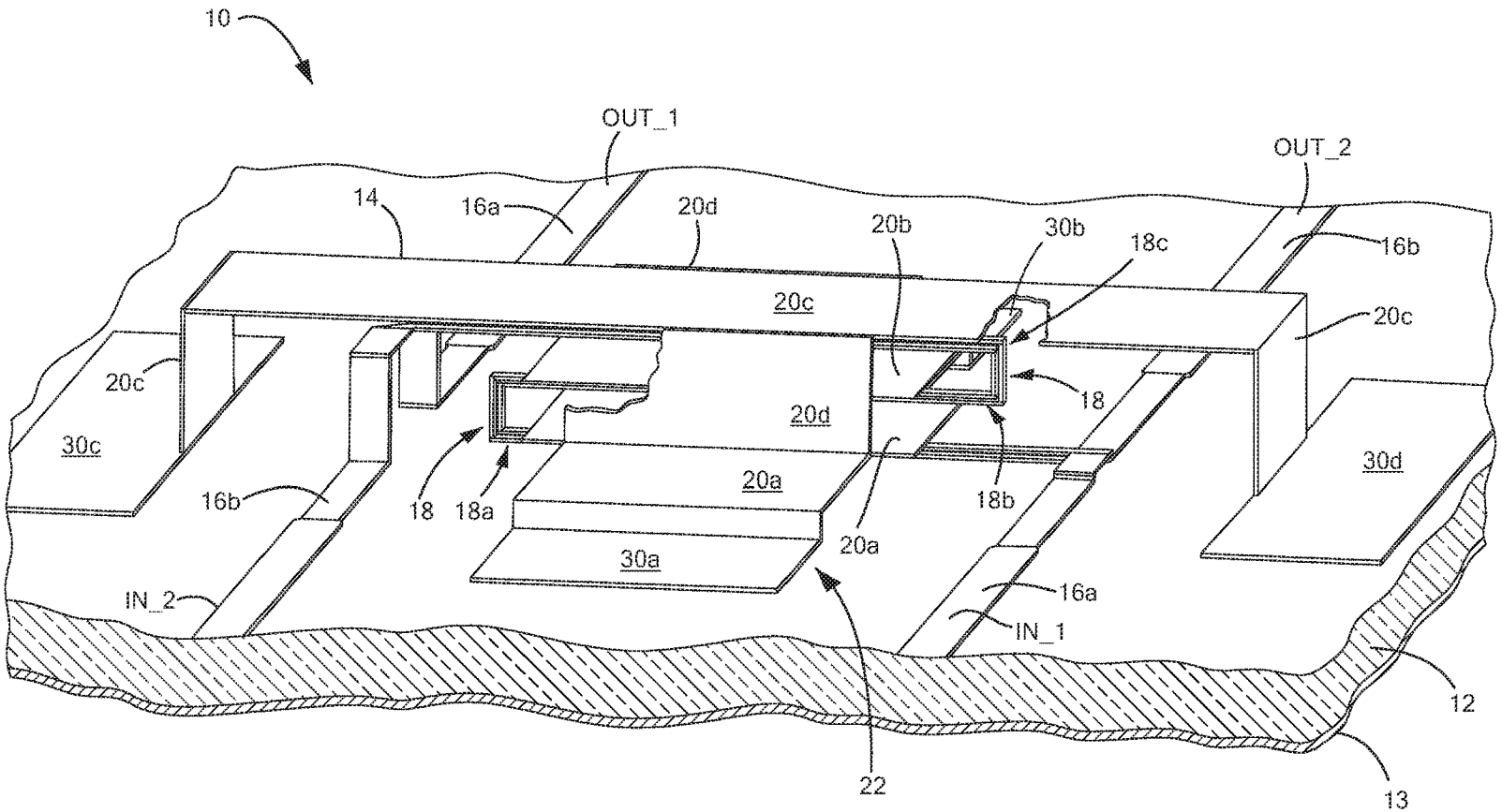
FIG. 4 is a perspective sketch of portions of the coupler of FIG. 2A with dielectric layers thereof being removed and a portion of one of the electrically conductive layers thereof partially broken away for simplicity in understanding the orientation of other shown portions of the coupler.

Referring now to FIG. 4, FIG. 4 is a perspective sketch of portions of the coupler of FIG. 2A with dielectric layers thereof being removed and a portion of one of the electrically conductive layers thereof partially broken away for simplicity in understanding the orientation of other shown portions of the coupler.

Figure 3A:
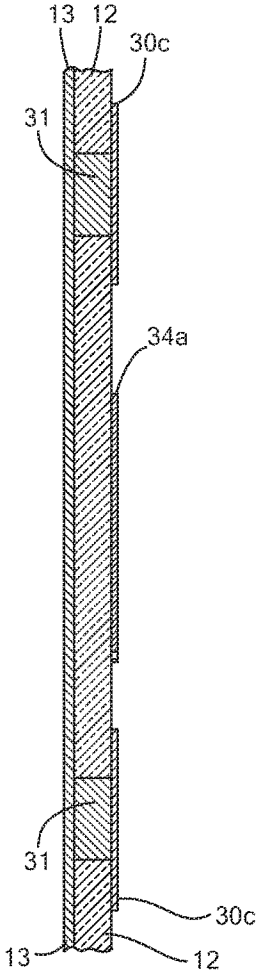
Figure 3A:
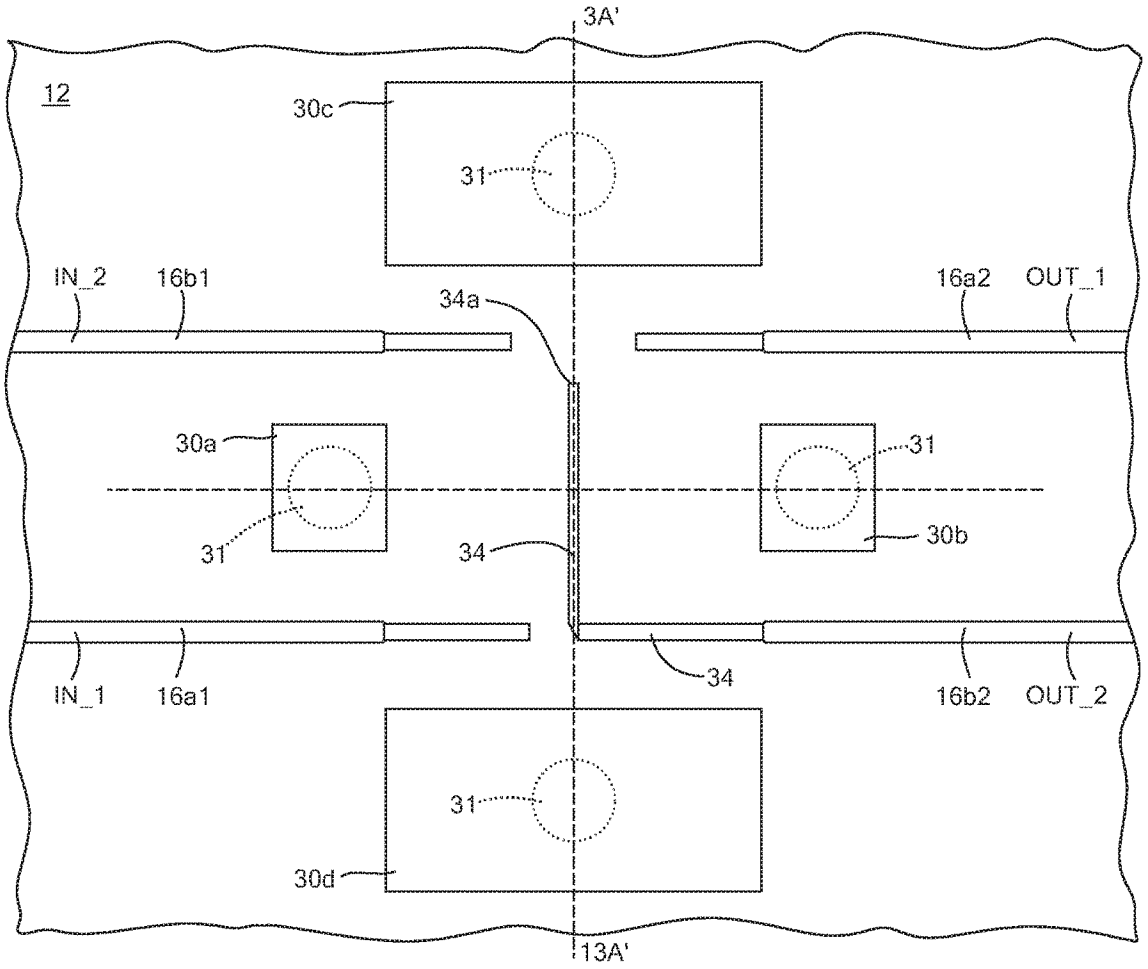
Figure 3B:
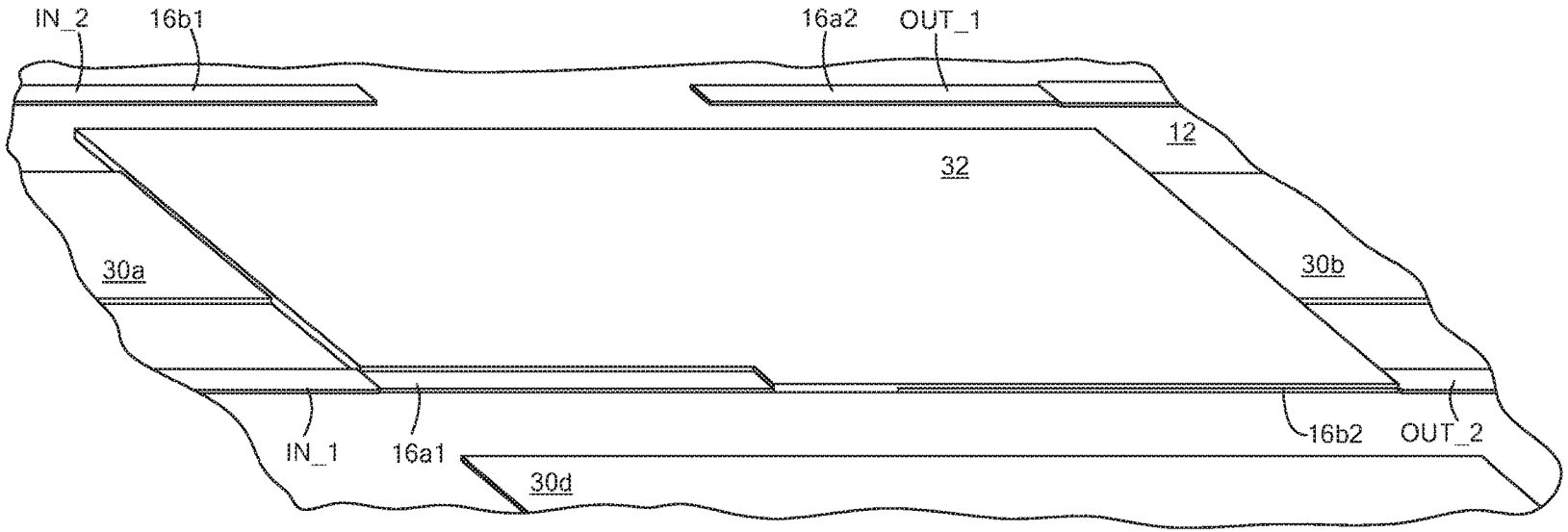
FIGS. 3B"-3T" are cross sectional views taken along lines 3B"-3T" in FIGS. 3B-3T, respectively.
Figure 3C:
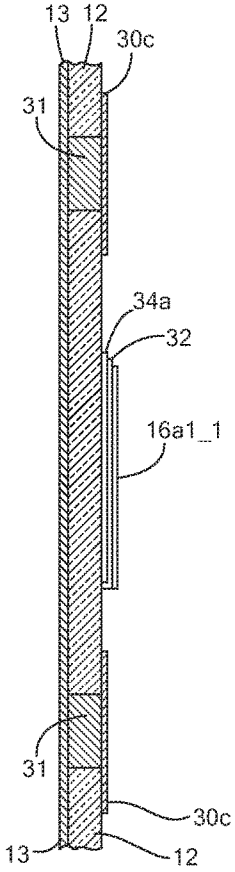
Figure 3C:
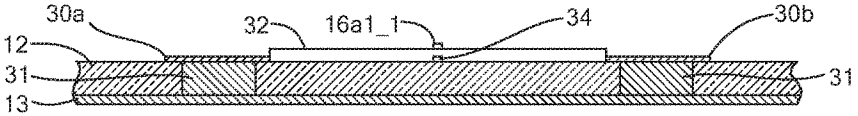
Figure 3C:
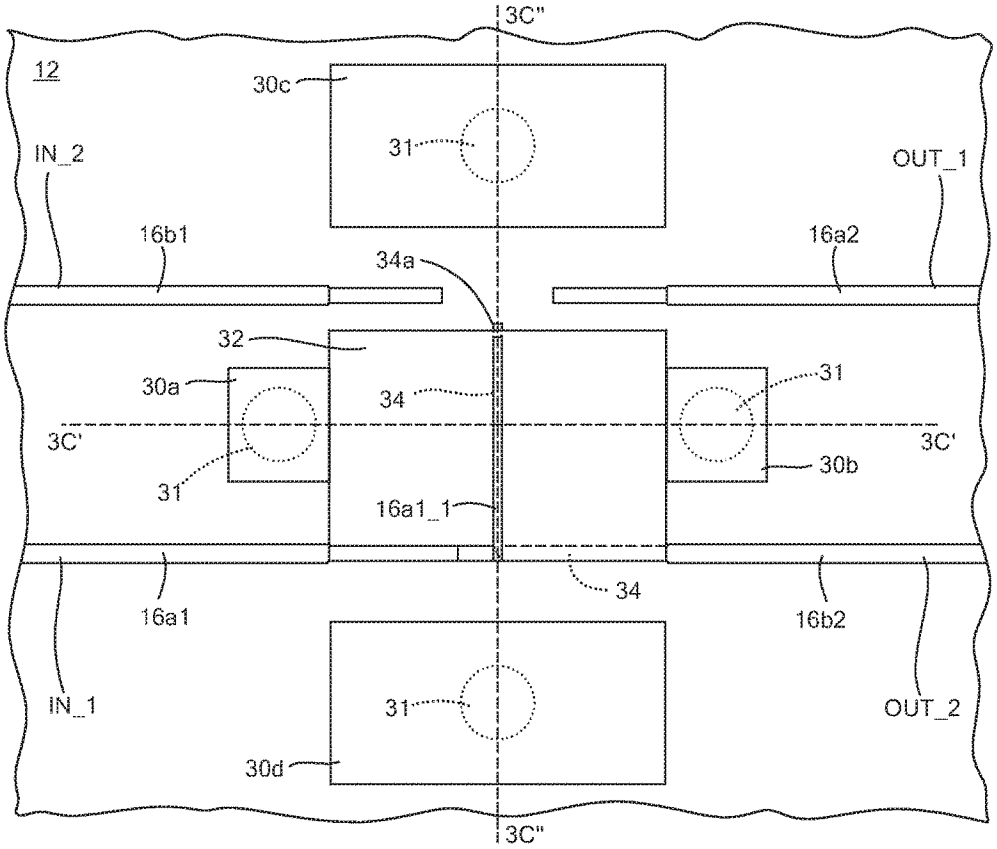
Figure 3C:
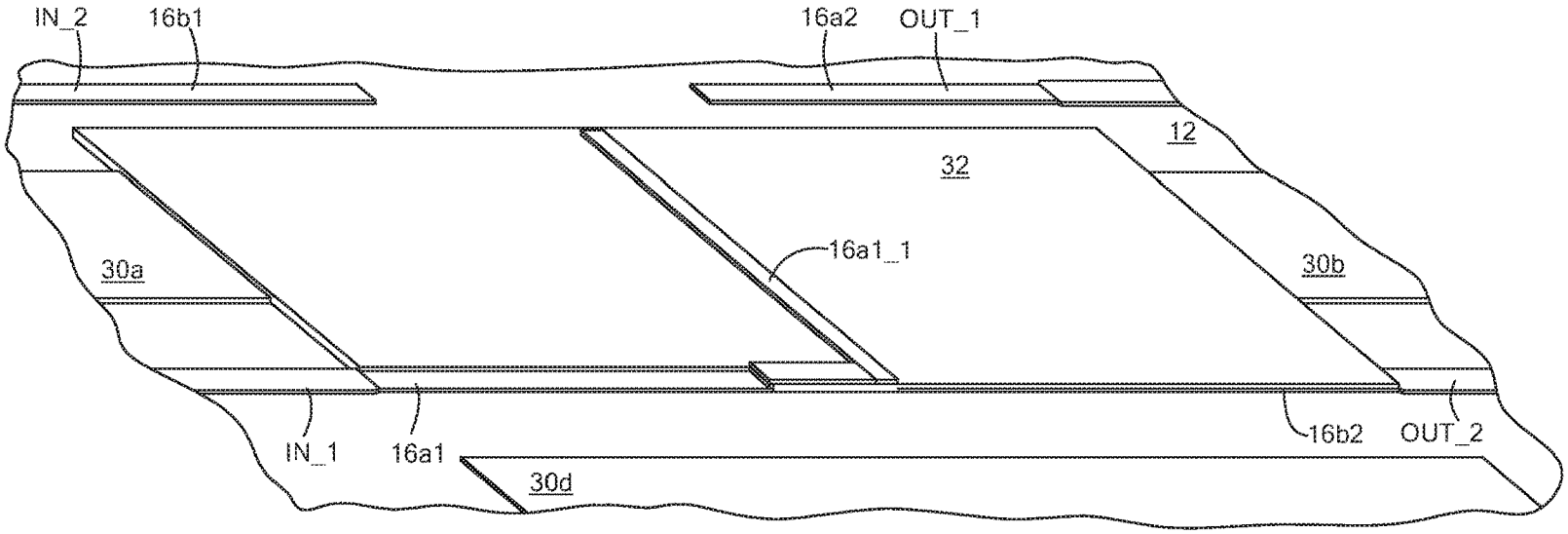
Figure 3D:
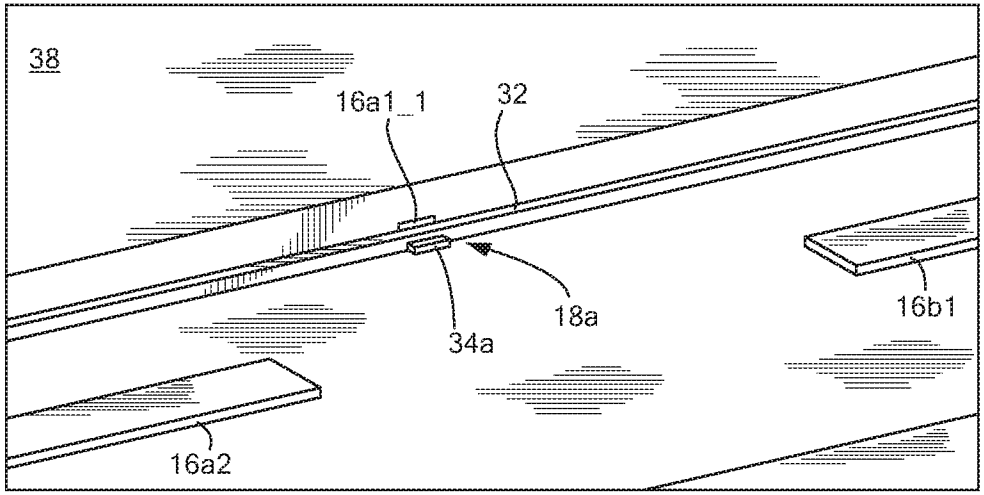
Figure 3G:
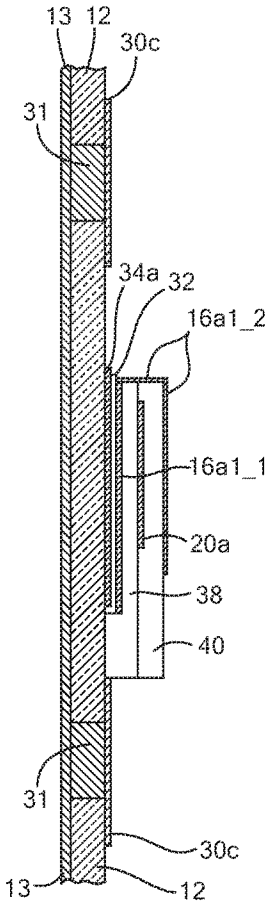
Figure 3G:
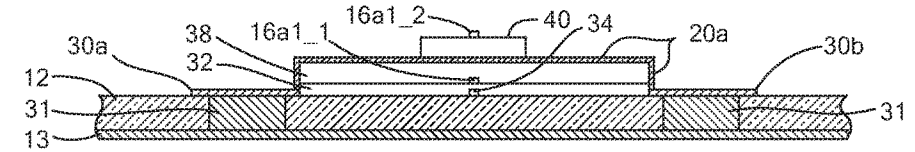
Figure 3G:
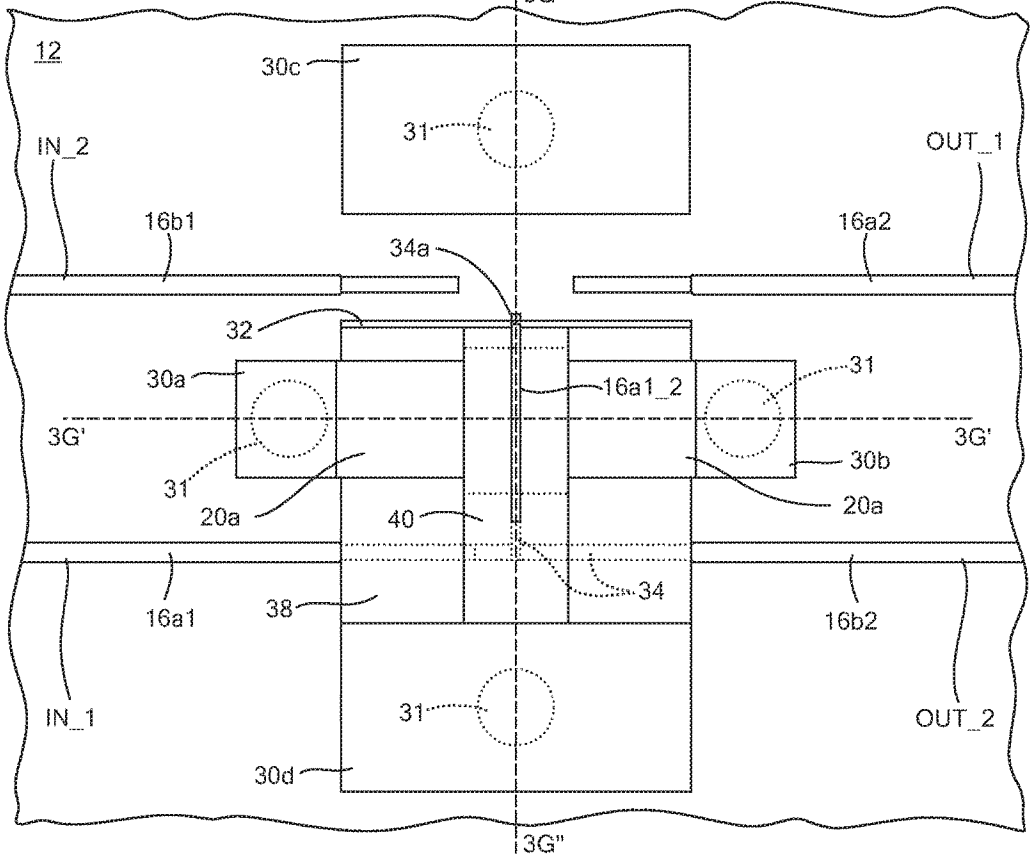
Figure 3G:
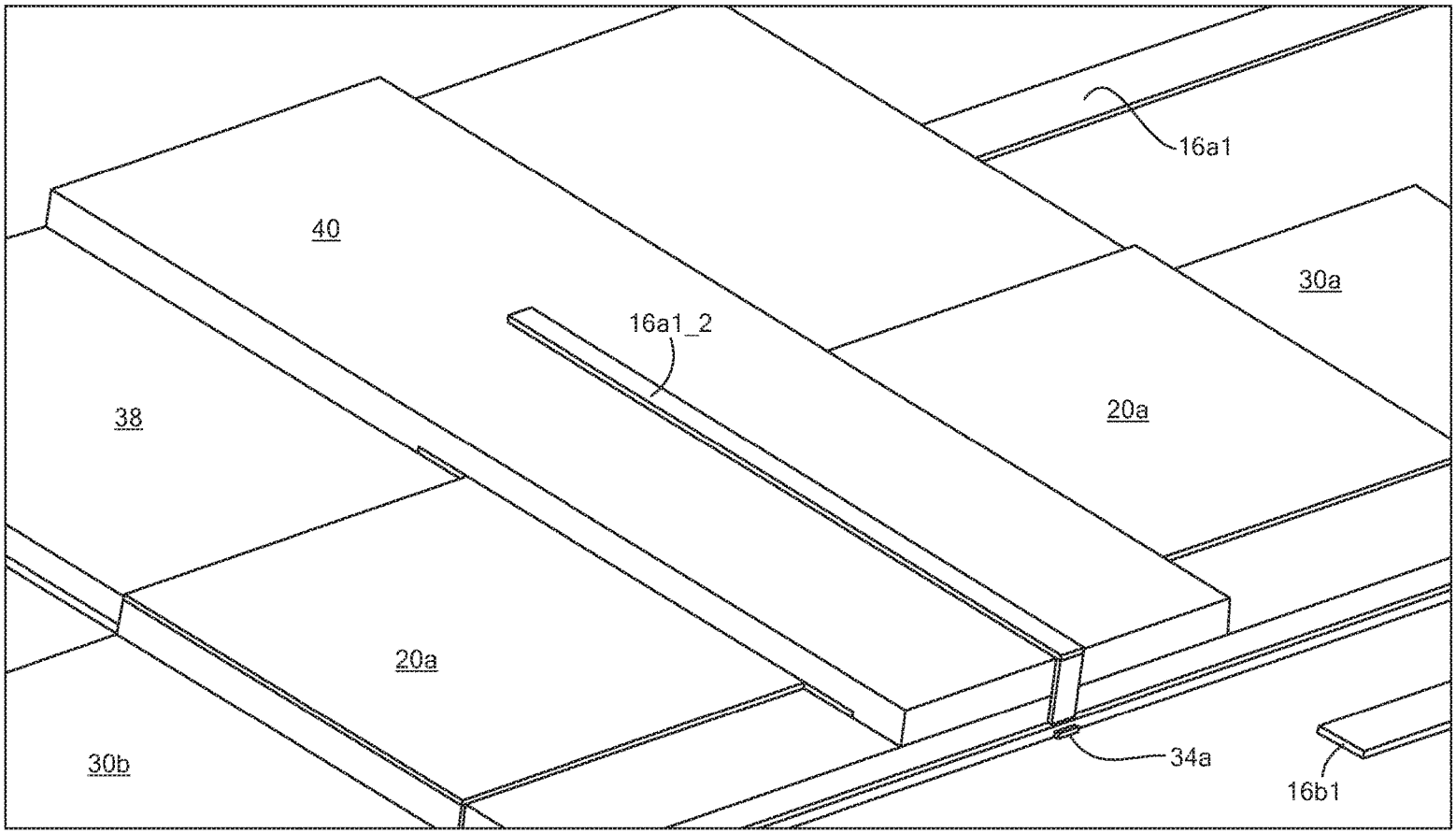
Figure 3H:
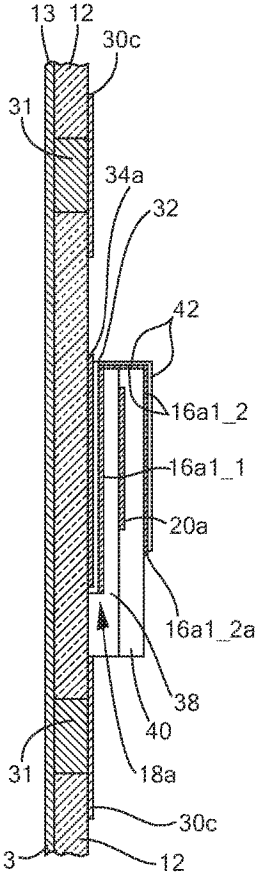
Figure 3H:
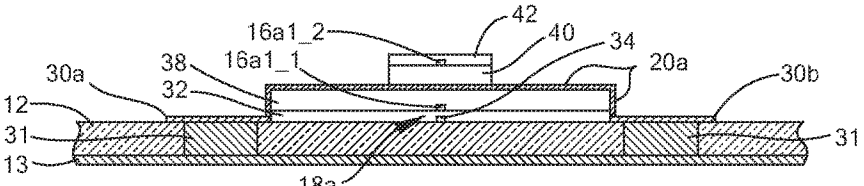
Figure 3H:
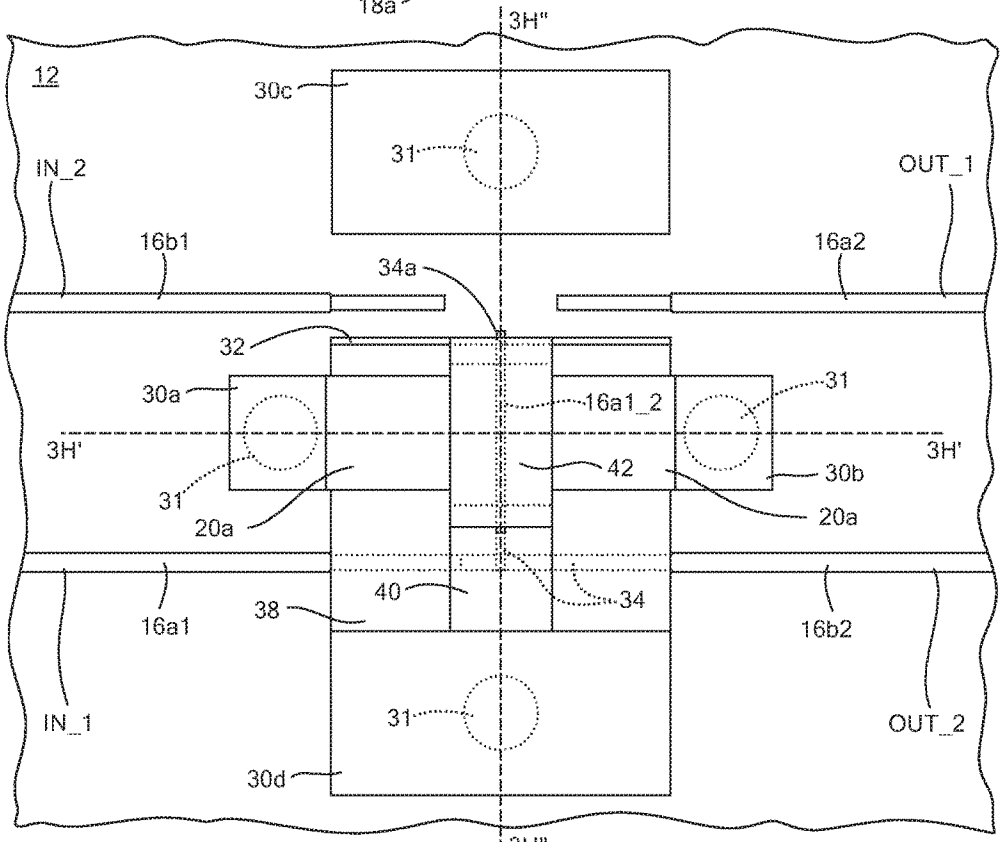
Figure 3H:
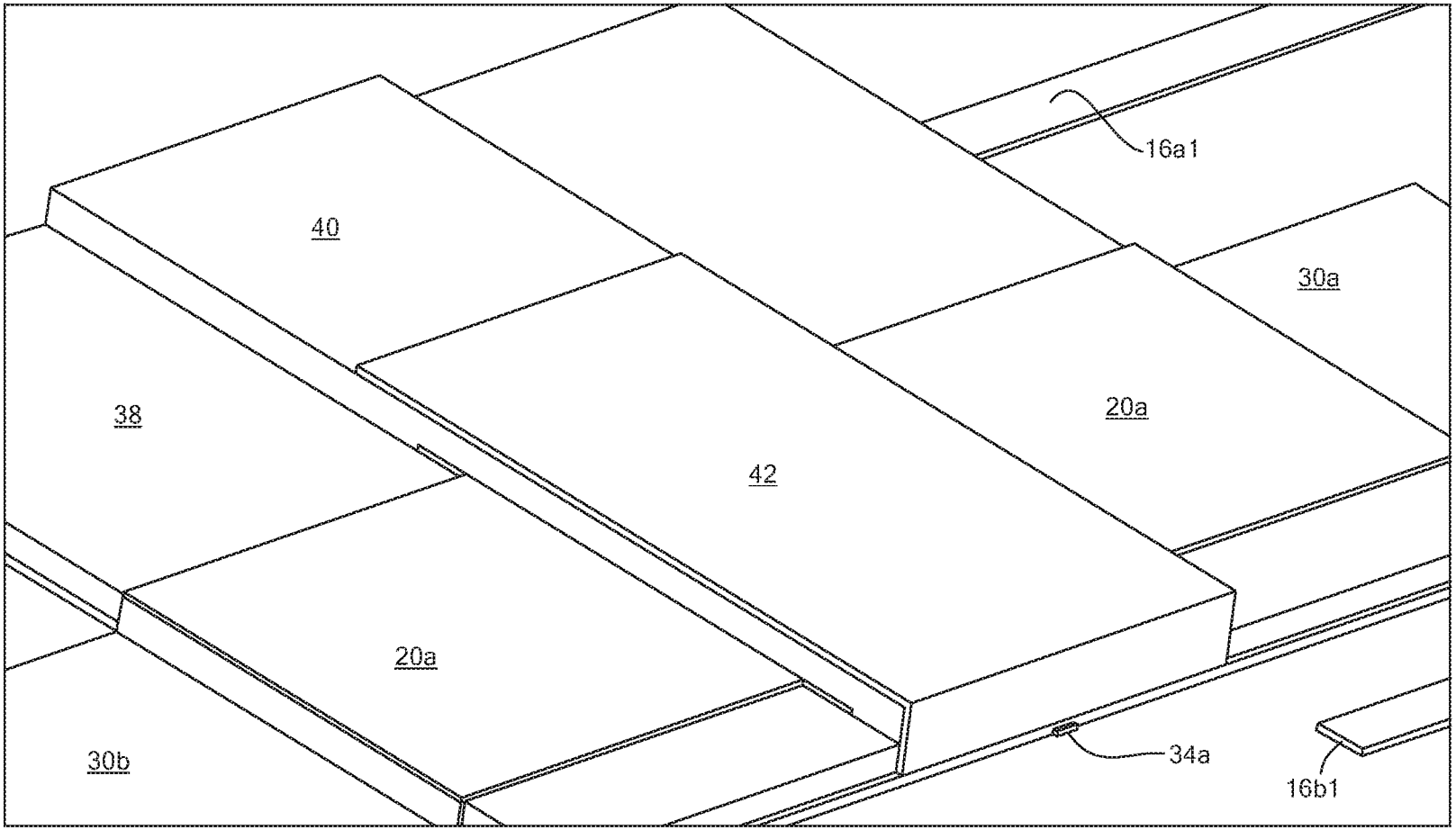
Figure 3I:
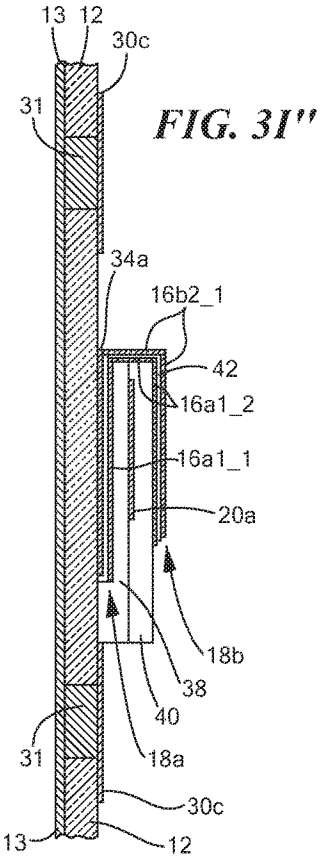
Figure 3I:
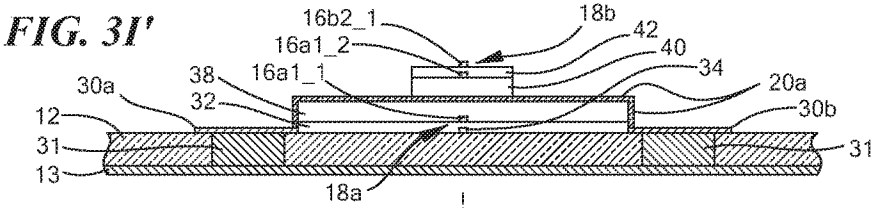
Figure 3I:
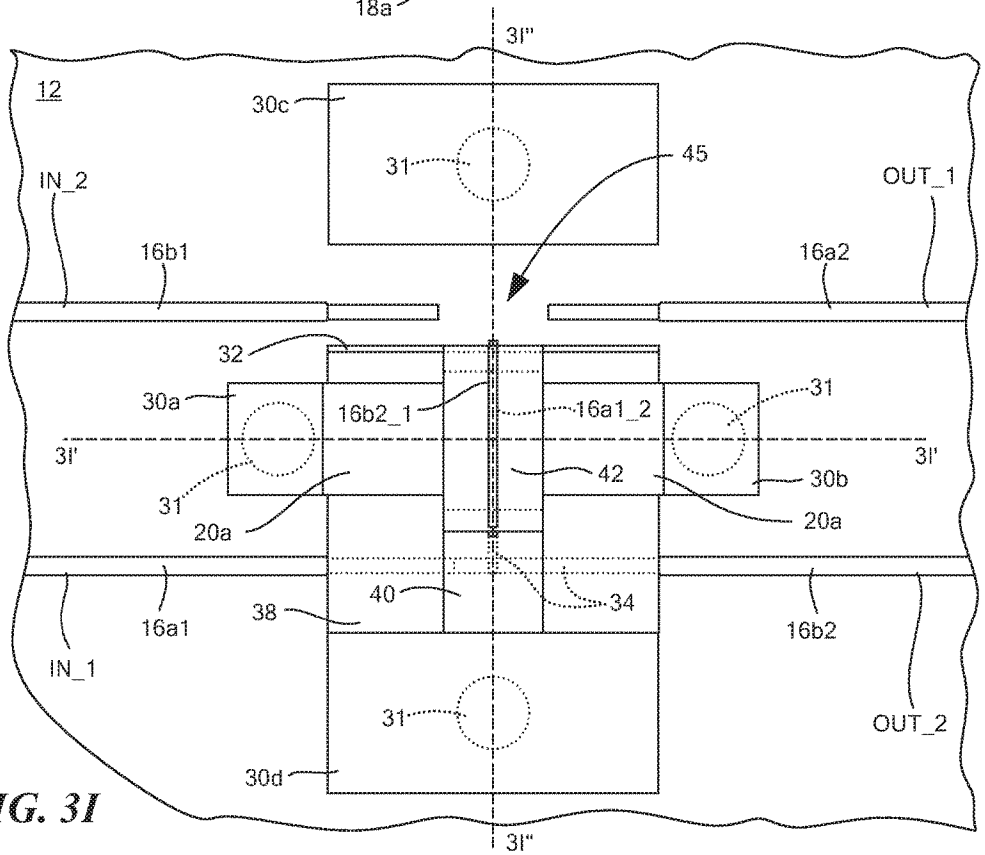
Figure 3I:
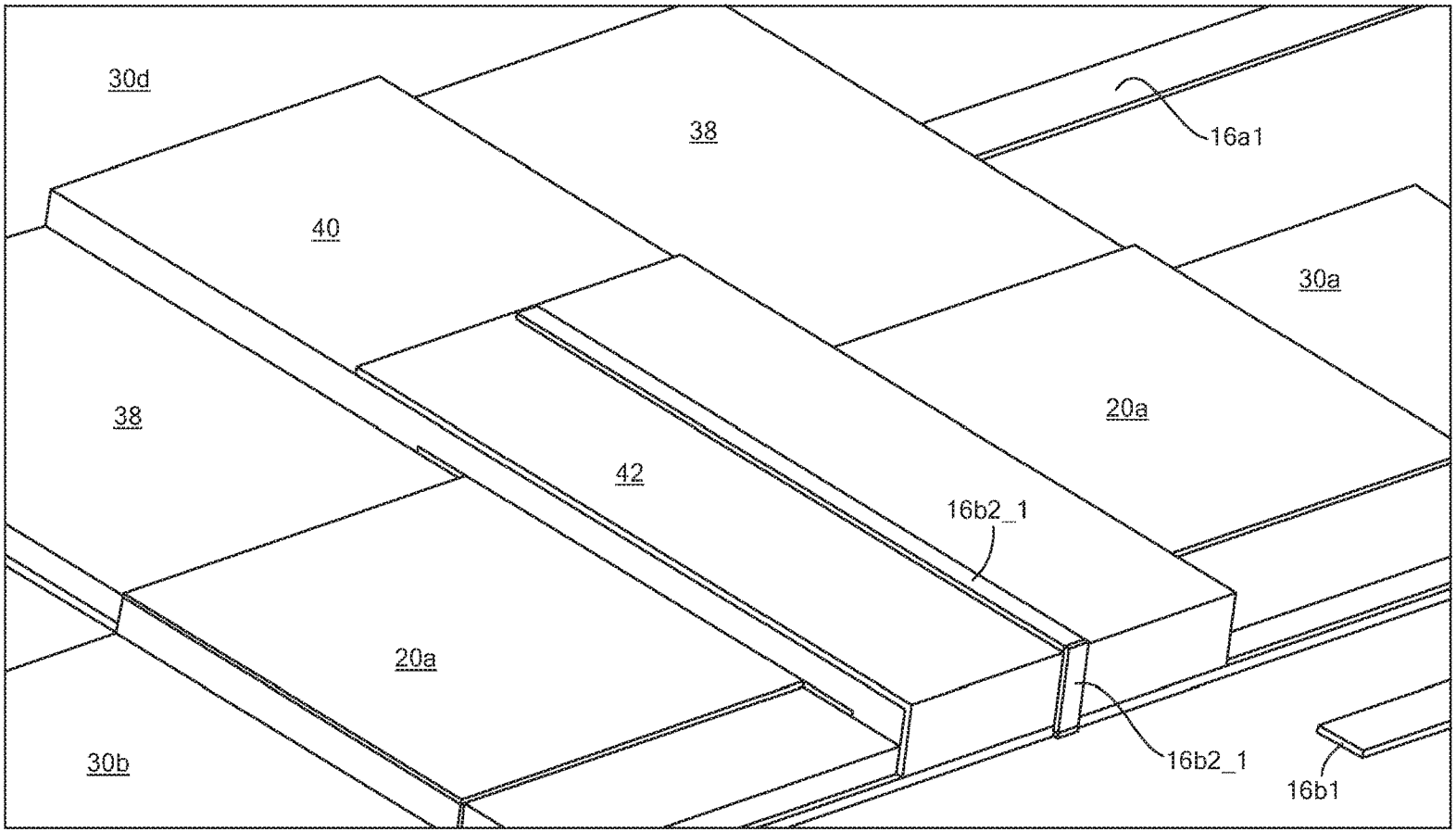
Figure 3J:
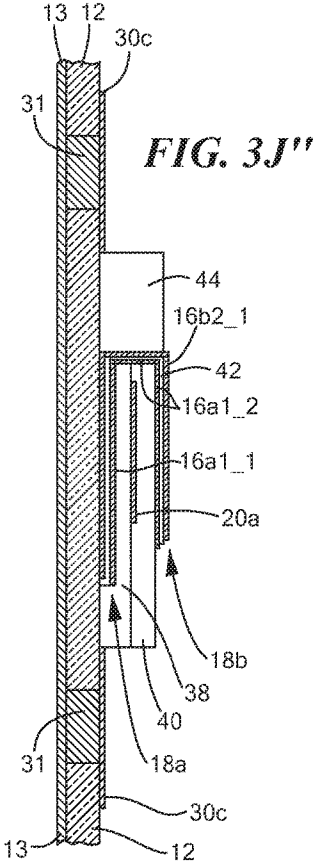
Figure 3J:
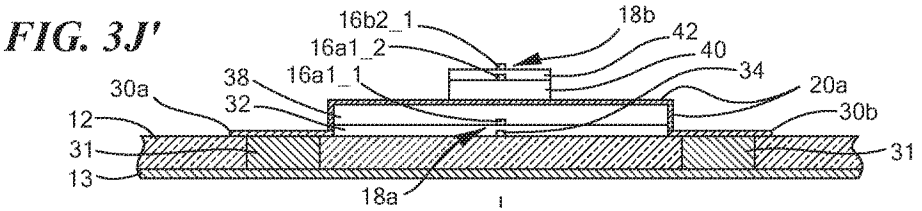
Figure 3J:
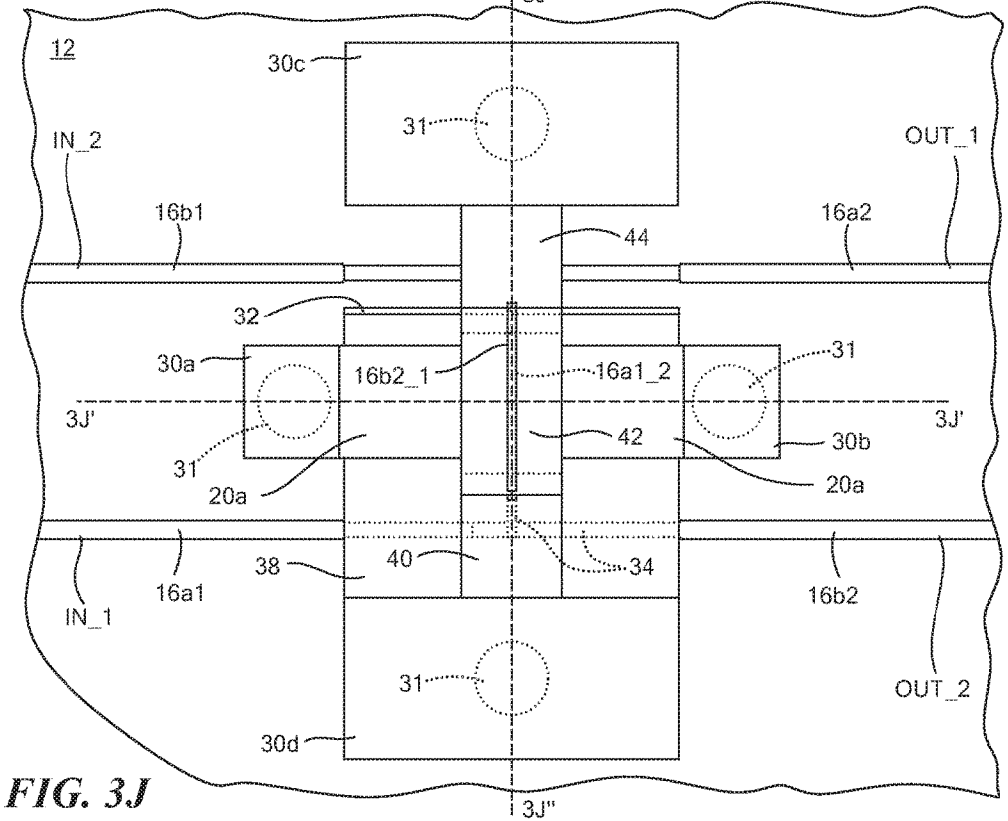
Figure 3J:
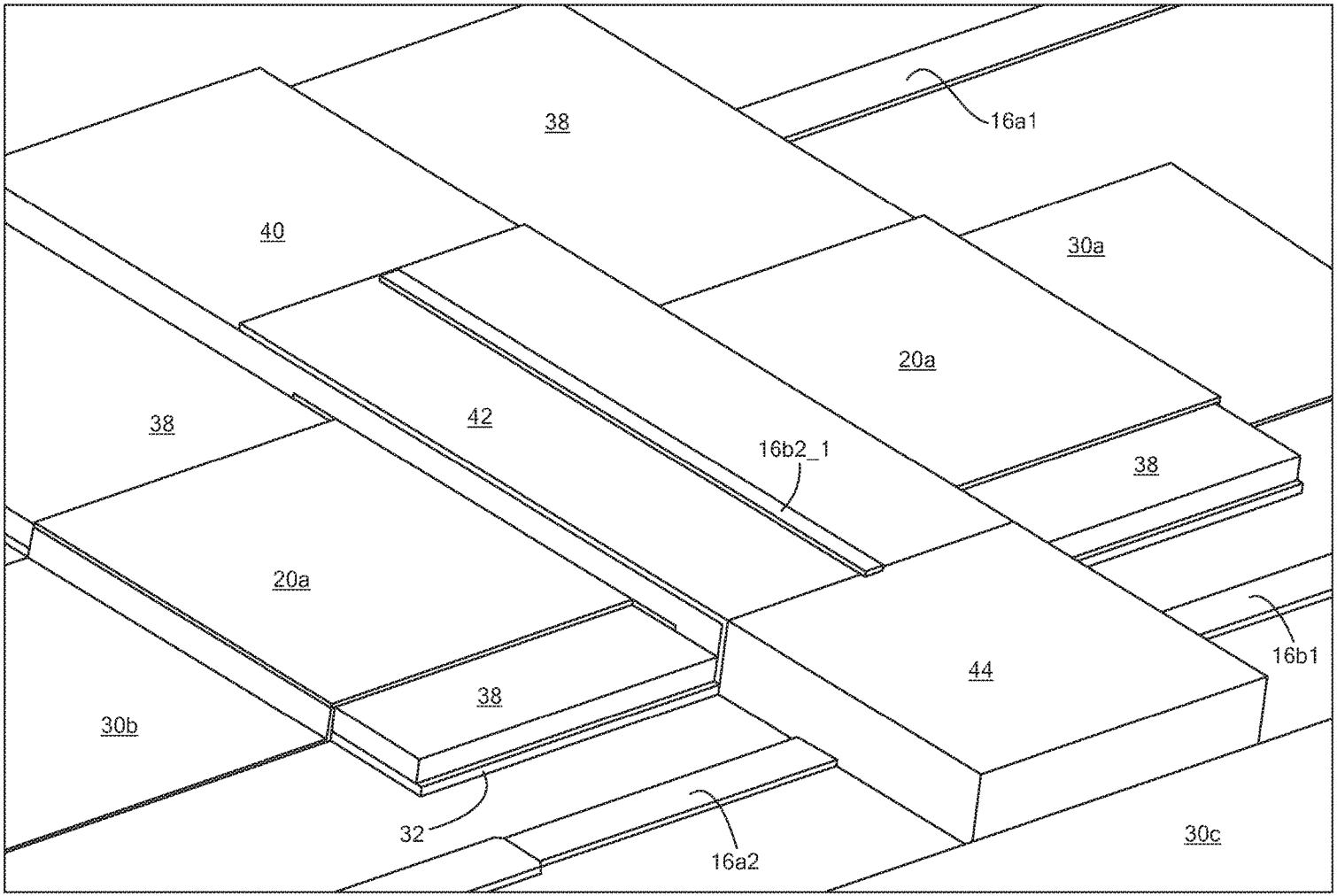
Figure 3K:
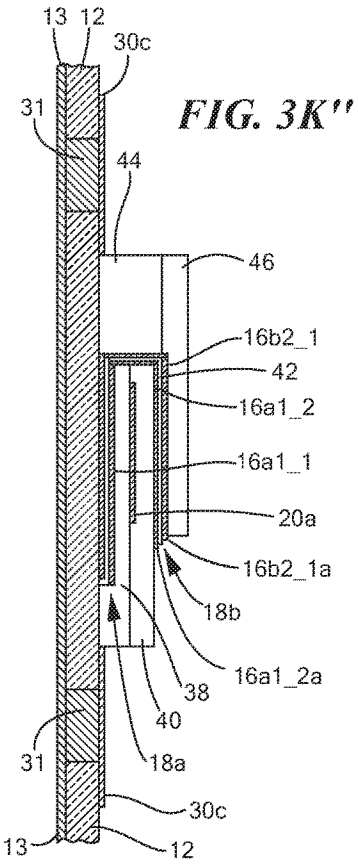
Figure 3K:
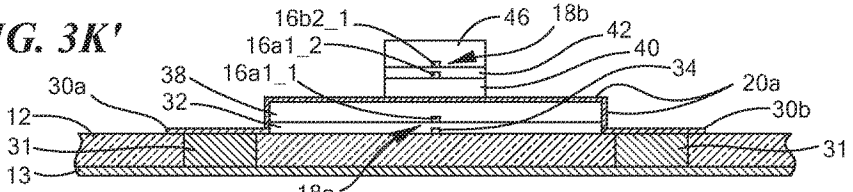
Figure 3K:
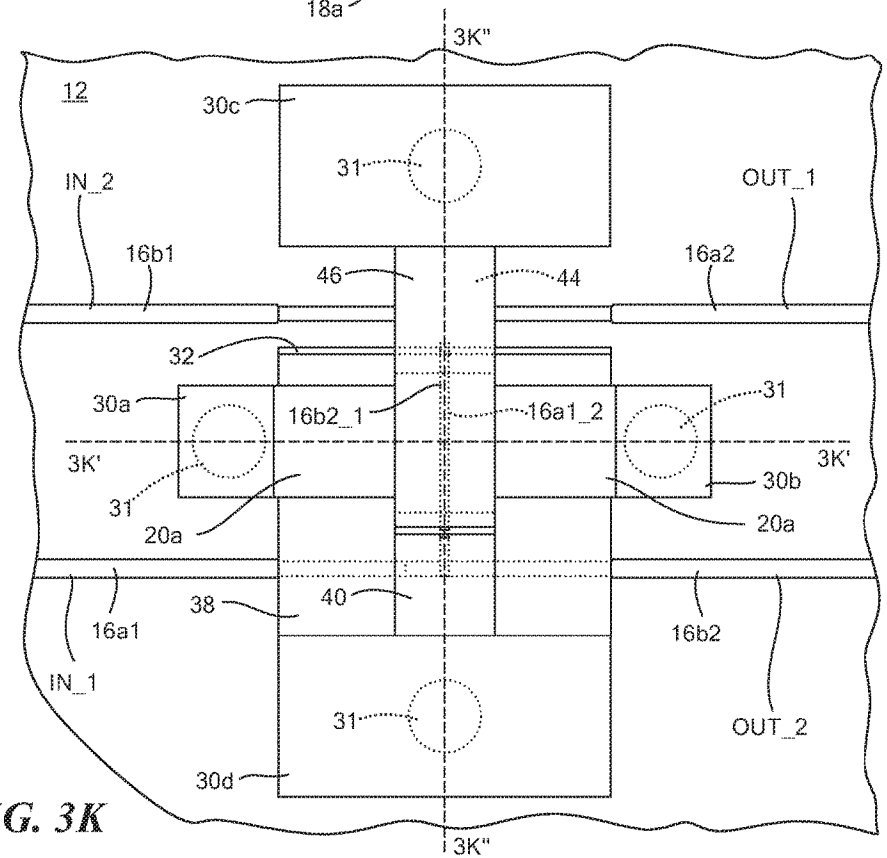
Figure 3K:
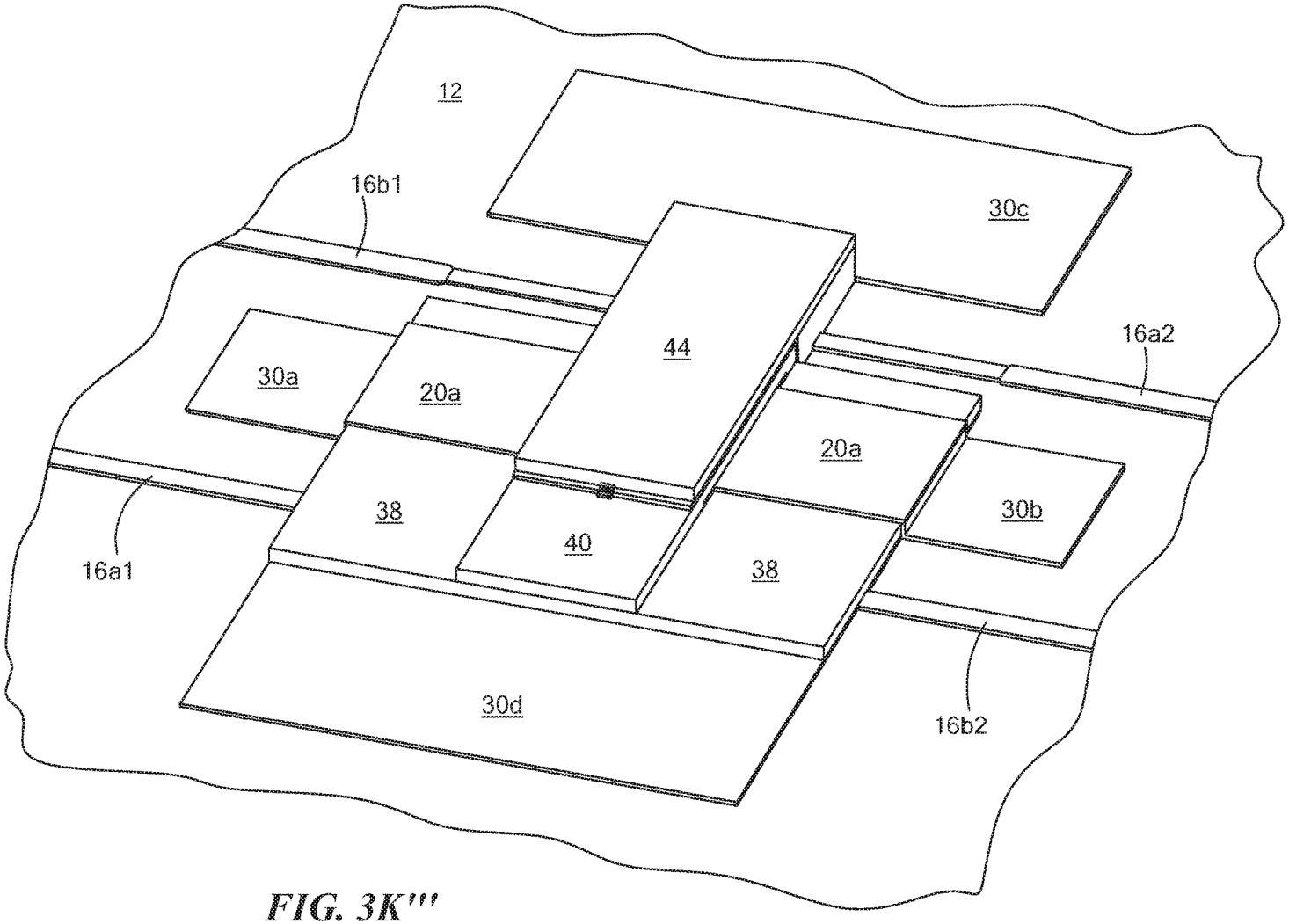
Figure 3L:
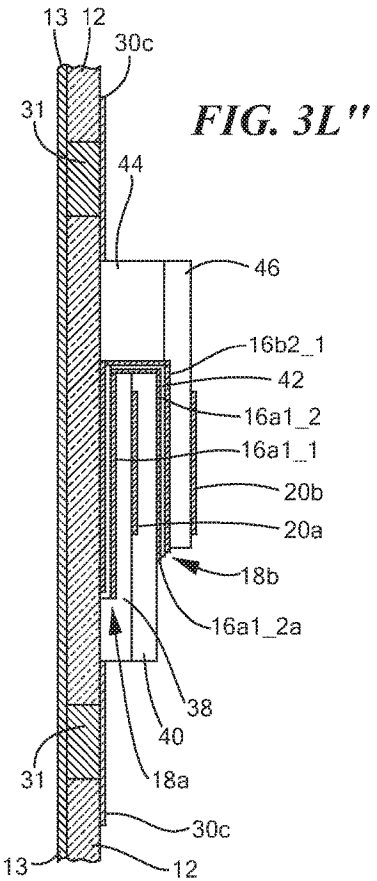
Figure 3L:
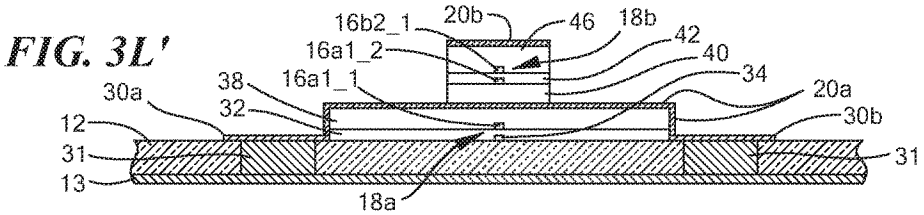
Figure 3L:
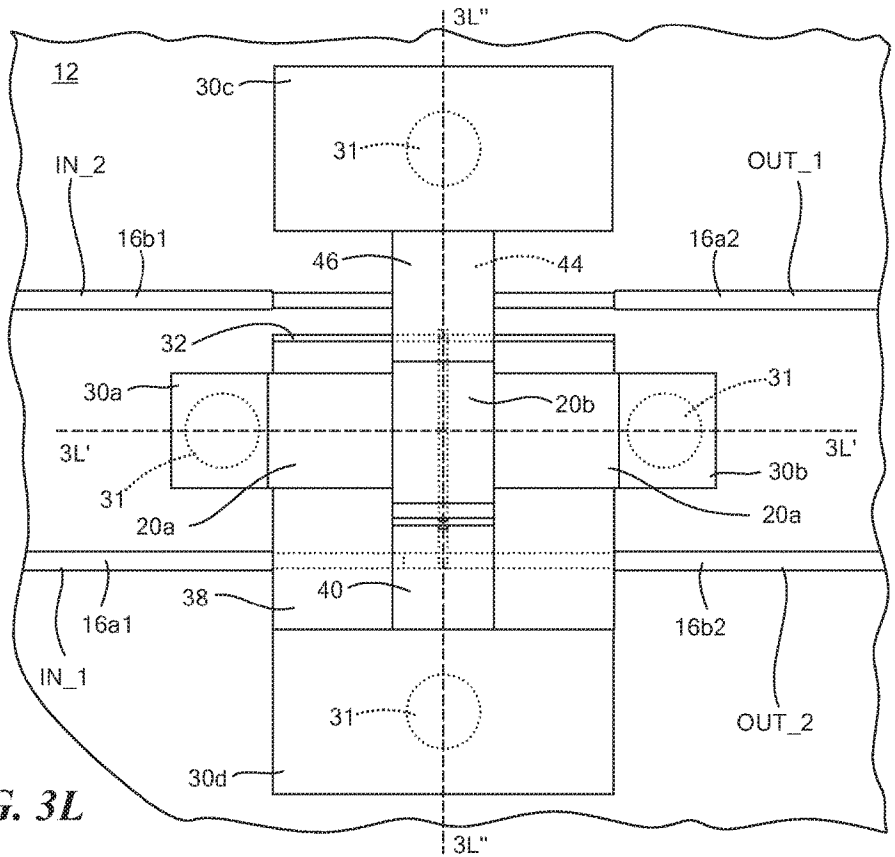
Figure 3M:
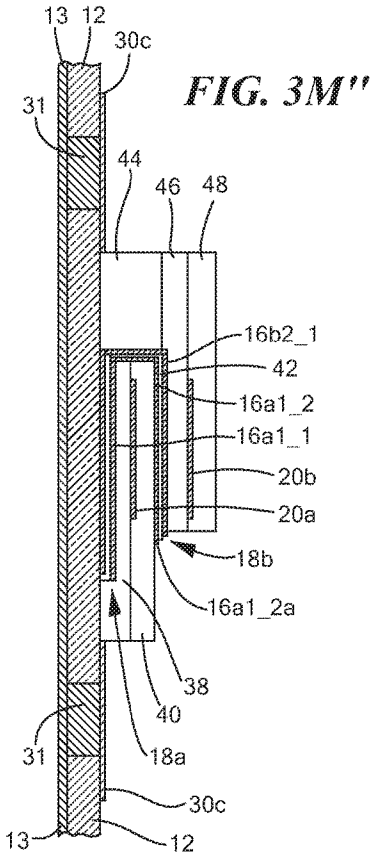
Figure 3M:
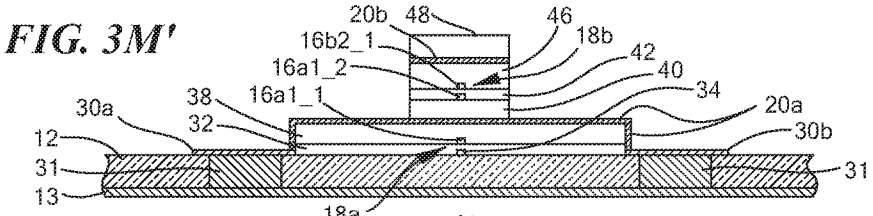
Figure 3M:
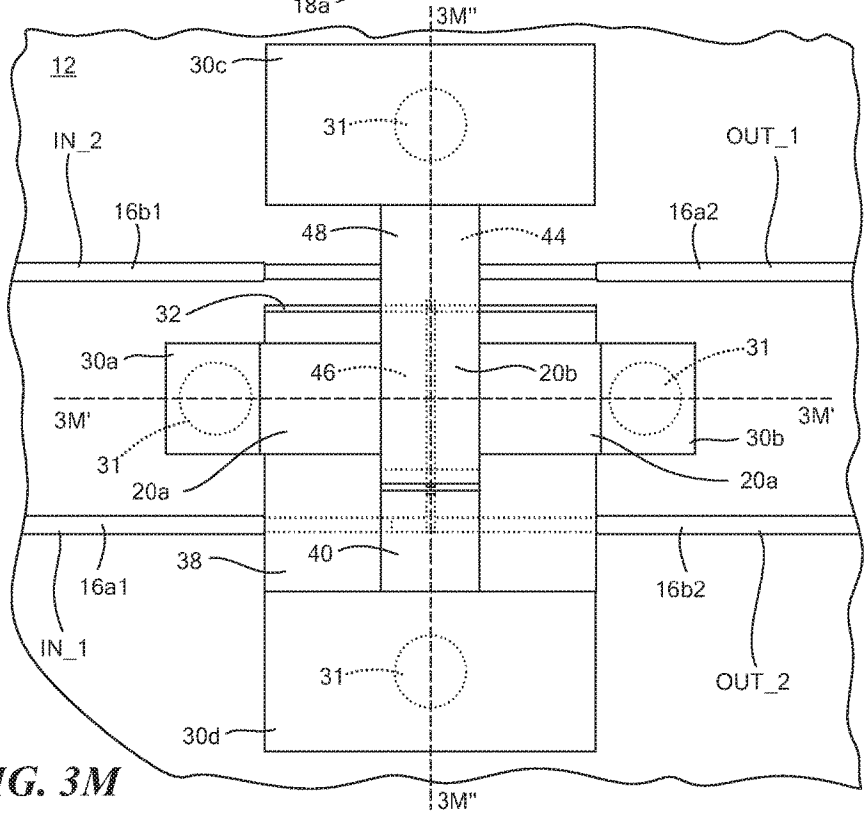
Figure 3N:
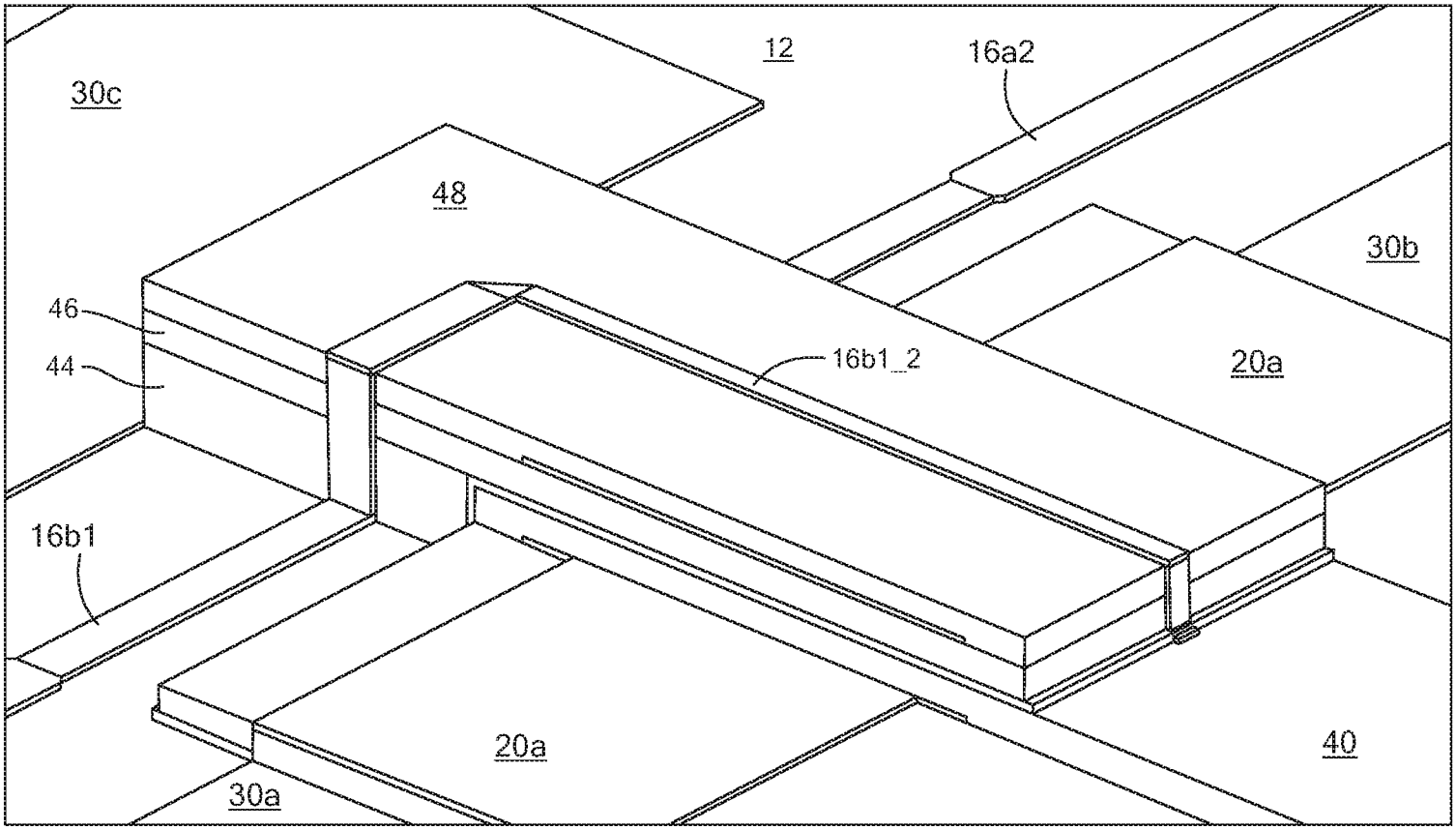
Figure 3P:
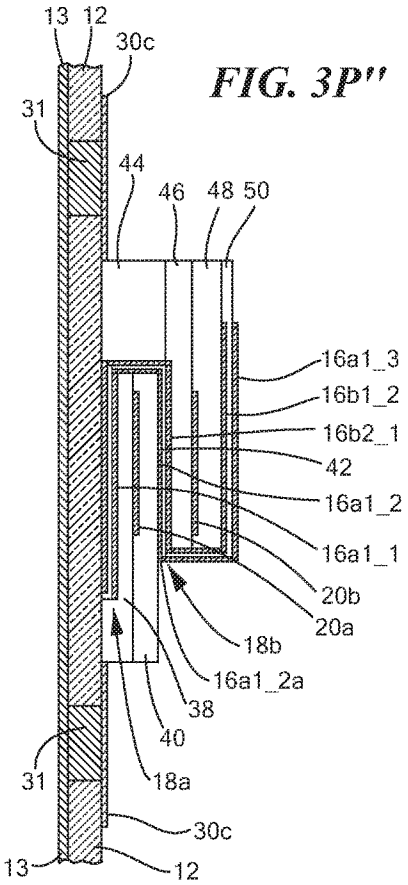
Figure 3P:
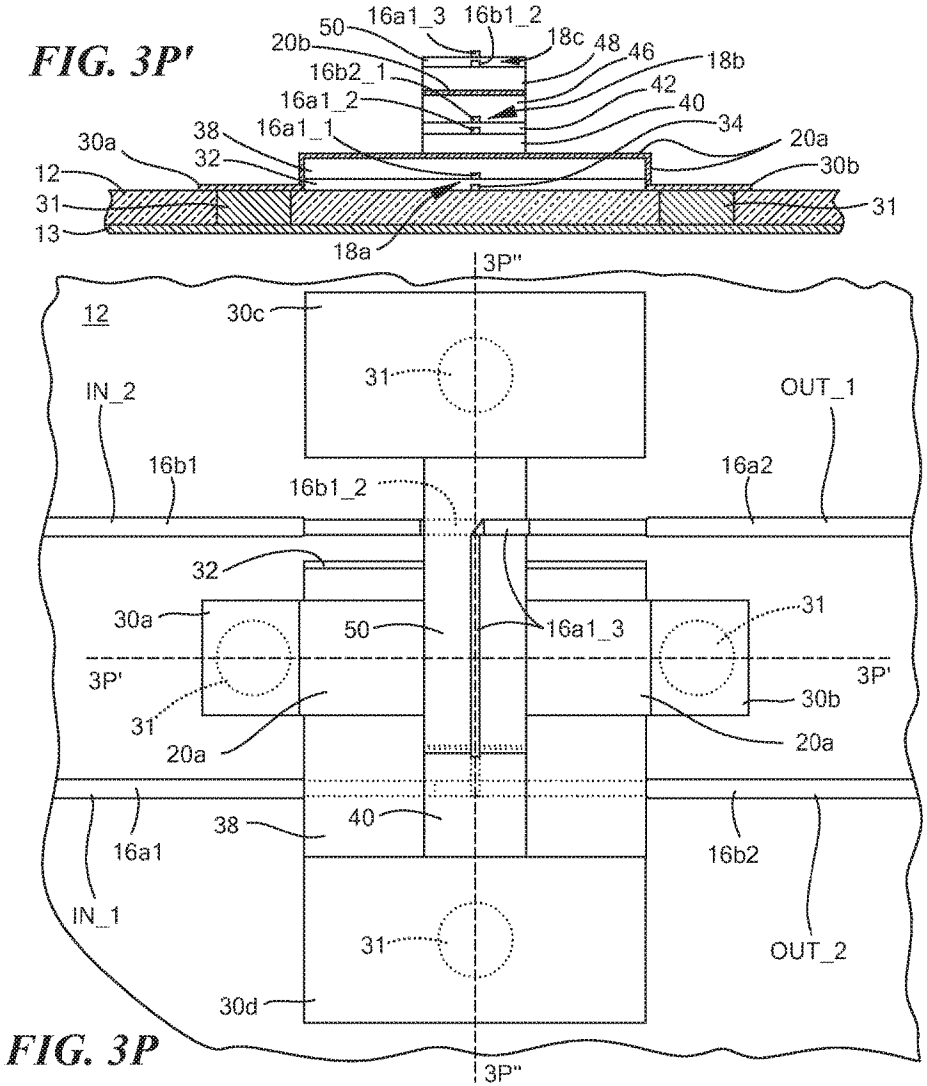
Figure 3P:
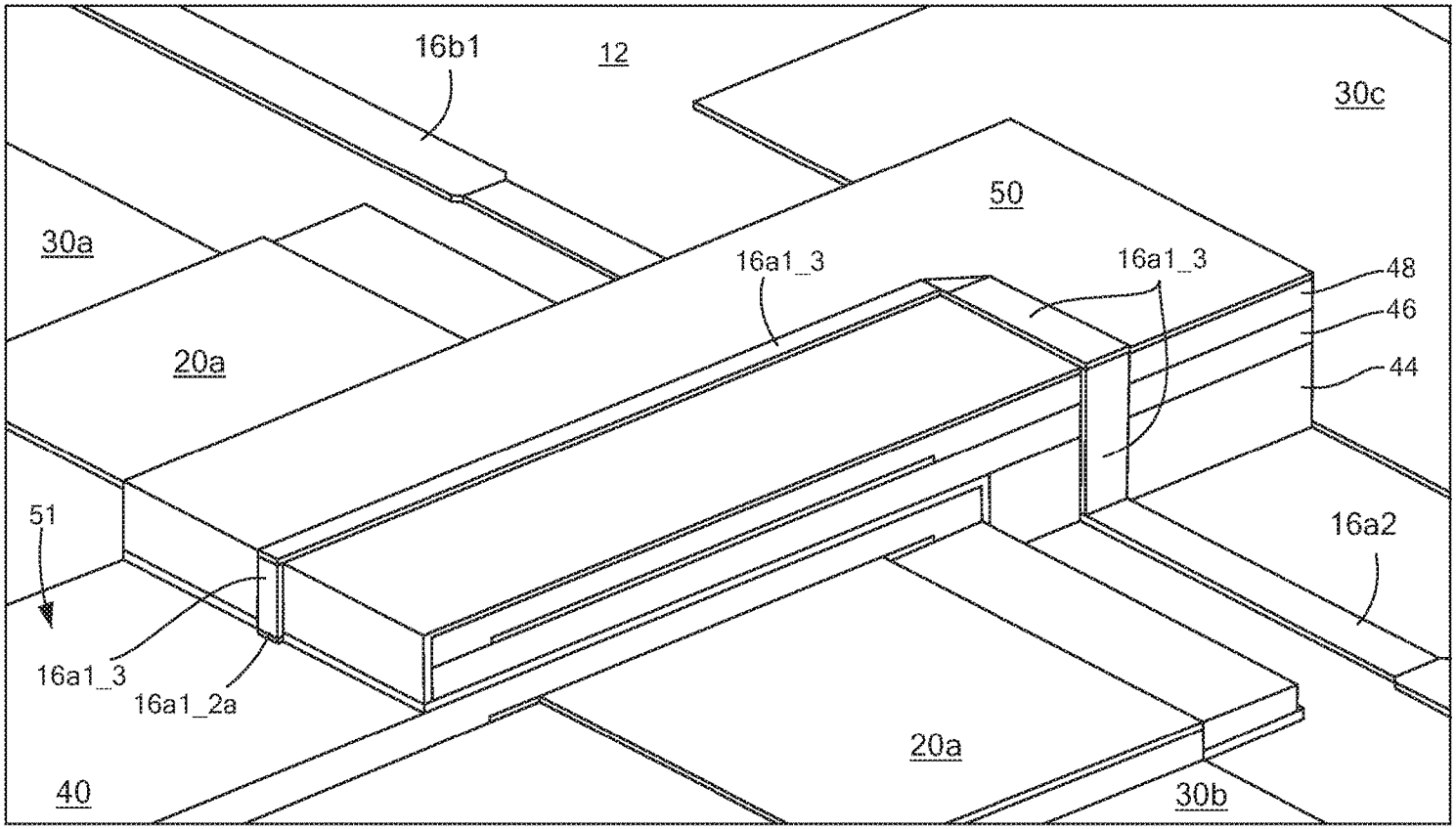
Figure 3Q:
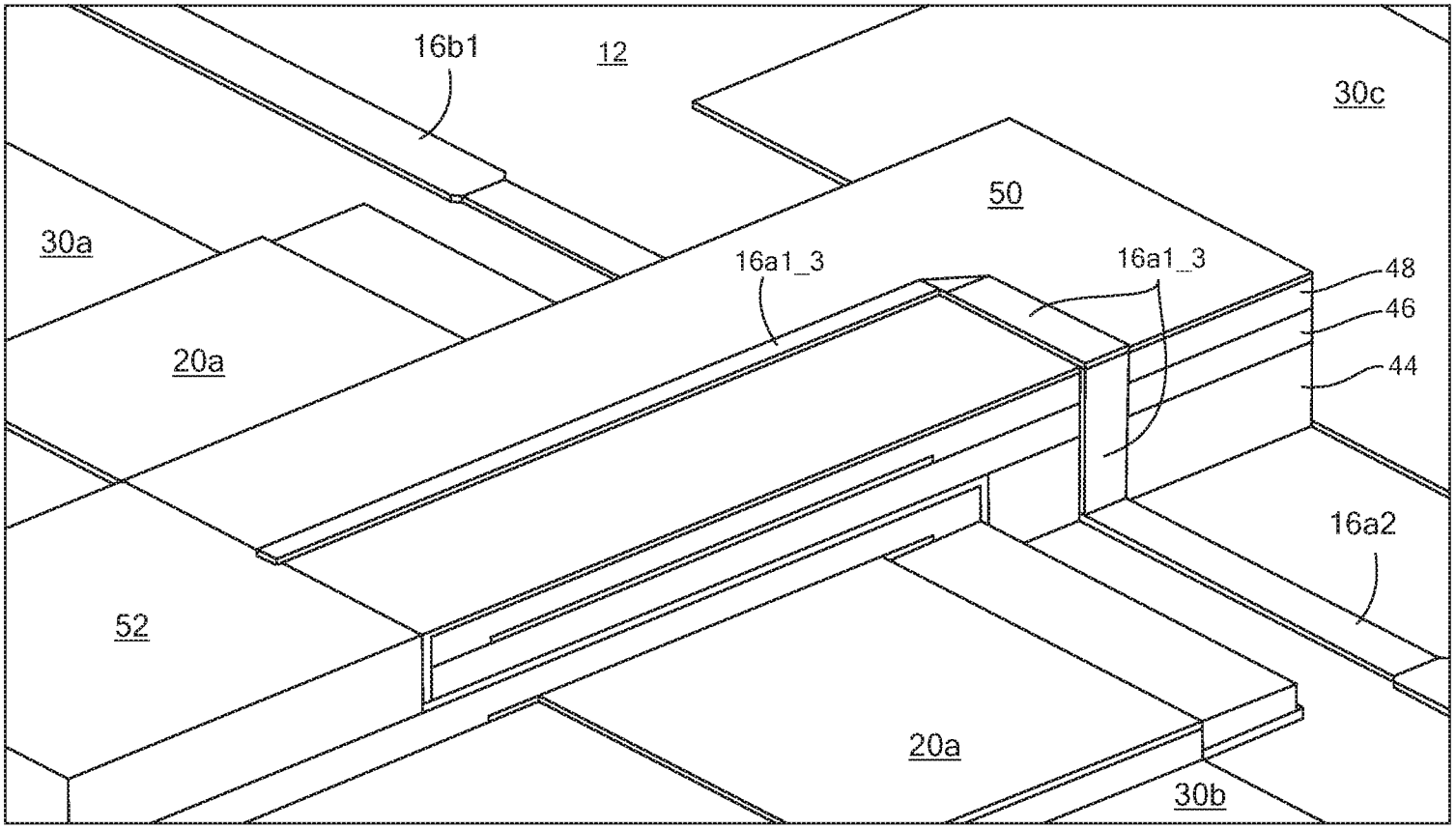
Figure 3R:
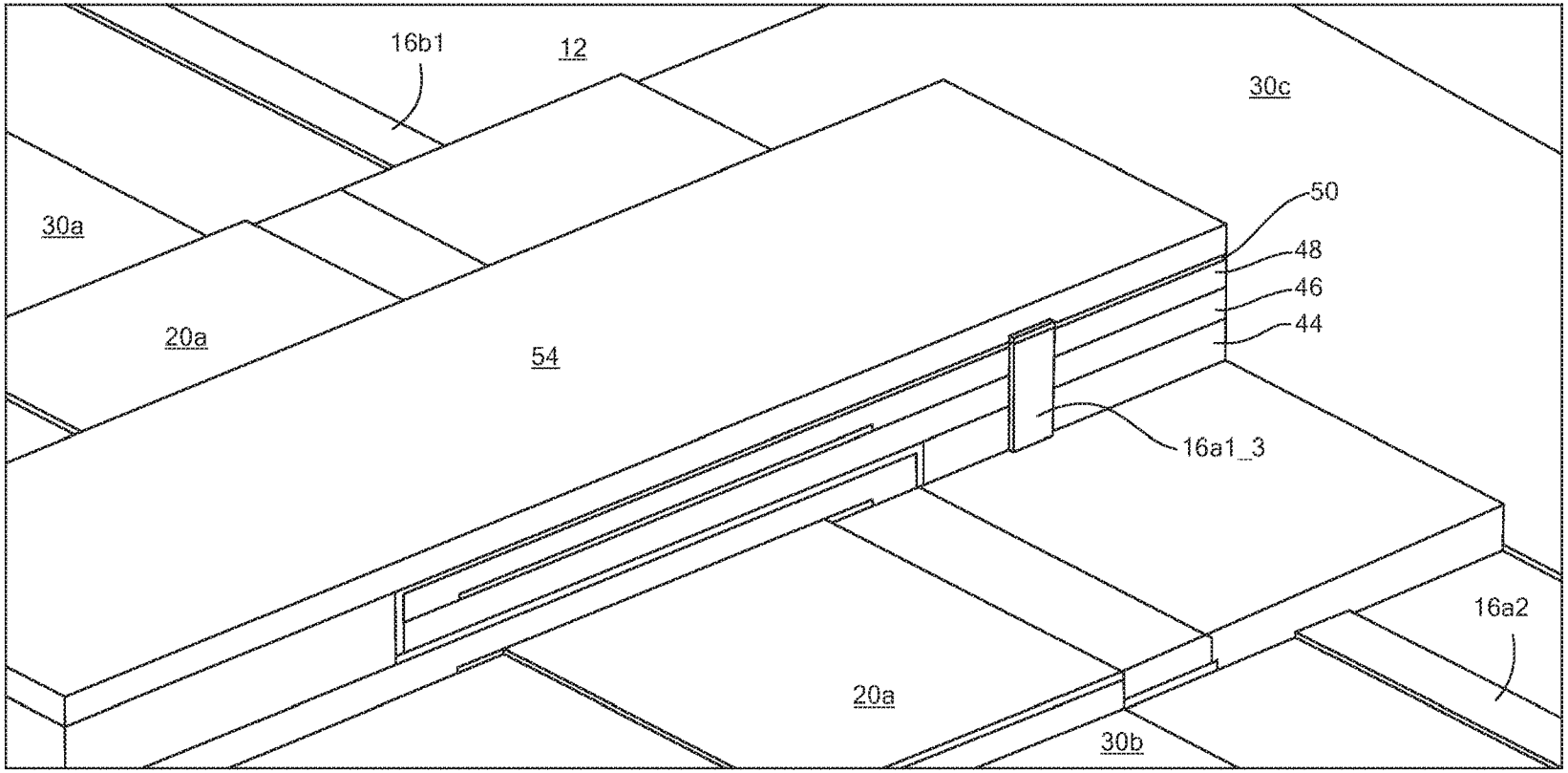
Figure 3S:
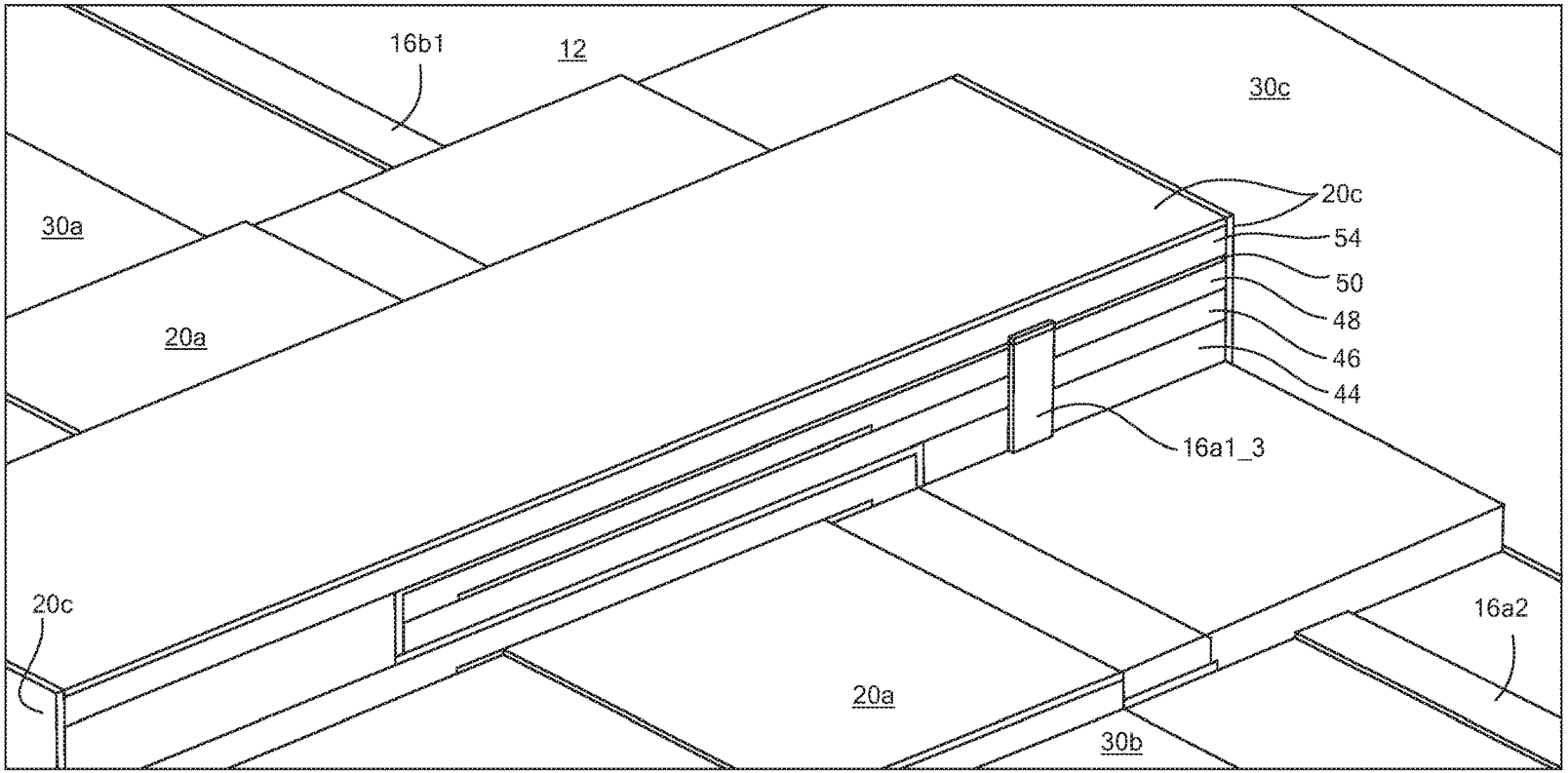
Figure 3T:
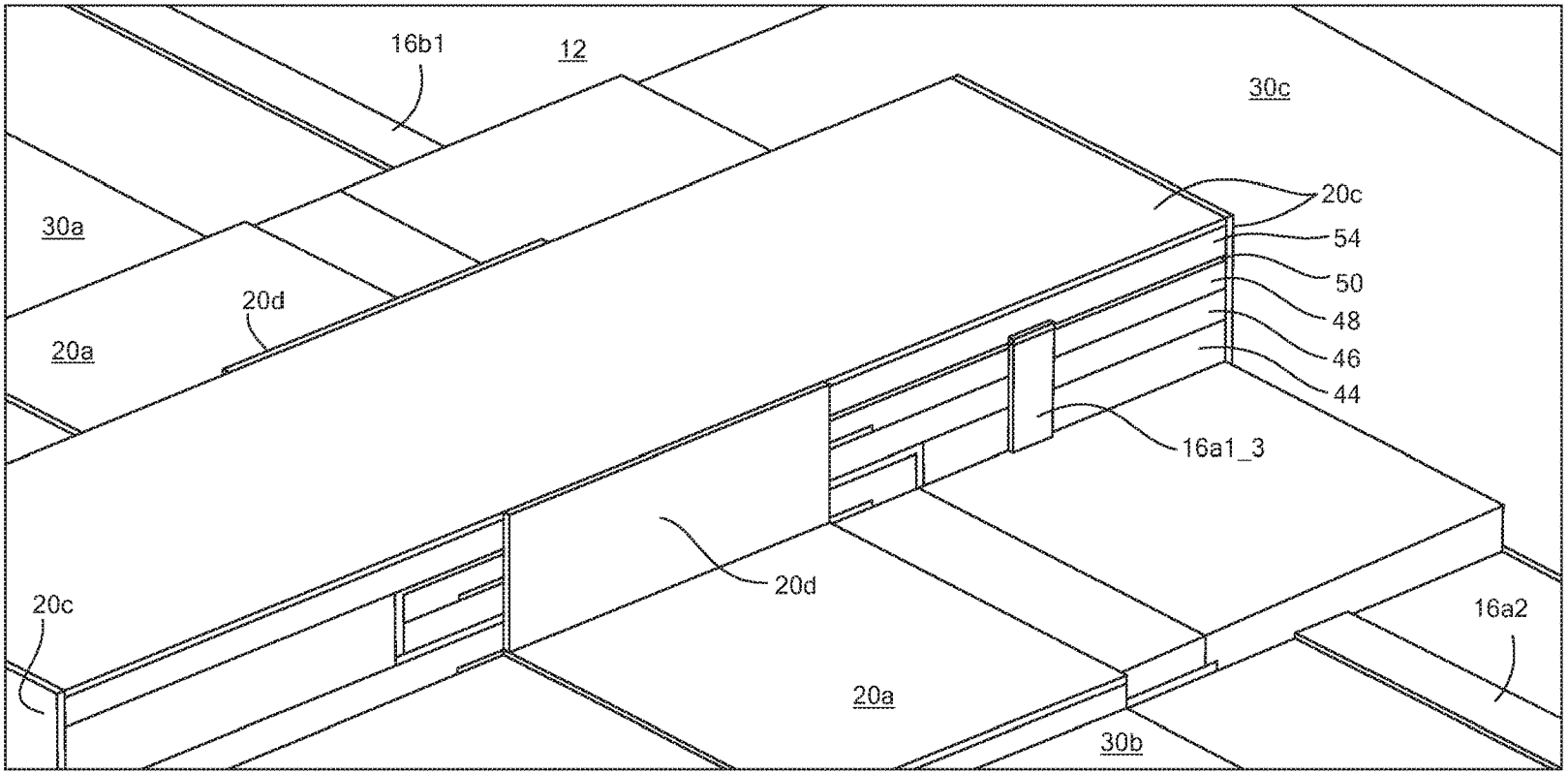

Referring now to FIGS. 3A-3T the process for forming the structure 10 will be described. Thus, referring to FIGS. 3A and 3A', the upper surface of the substrate 12, with the ground plane conductor 13 (FIG. 3A) on the bottom thereof, has a pattern of conductive elements formed thereon for example by etching a sheet of conductive material or by a 3D printing or additive manufacturing, to form: ground plane conductive pads 30*a*, 30*b*, 30*c* and 30*d* connected to the ground plane conductor 13 (FIGS. 2B and 2C) by electrically conductive vias 31, as indicated; portions $\mathbf{16}a_1$ of the strip conductors 16*a*; portions $\mathbf{16}a_2$ of the strip conductors 16*a*; portions $\mathbf{16}b_1$ of the strip conductors 16*b*; and portions $\mathbf{16}b_2$ of the strip conductors 16*b*.

Referring now to FIGS. 3B, 3B', 3B" and 3B"', a dielectric layer 32 (FIGS. 3B', 3B") is 3D printed over the area of the surface of the substrate 12 where the coupling region 18 (FIGS. 2B and 2C) is to be formed; a portion of the dielectric layer 32 being disposed on portions 34 (FIGS. 3B and 3B') of the portions $\mathbf{16}b_2$ of the strip conductor 16*b*, as shown; it being noted that an end portion 34*a* (FIGS. 3D and 3D"') of the portion $\mathbf{16}b_2$ of the strip conductor 16*b* remaining uncovered by the dielectric layer 32.

Referring now to FIGS. 3C, 3C', 3C", and 3C"', using a conductive ink, a conductive strip portions 16*a*1_1 (FIGS. 3C', 3C" and 3C"') of strip conductor 16*a* are printed on a vertical edge of the dielectric layer 32 and up and onto the surface of the dielectric layer 32 to connect conductive strip portions 16*a*1 to portion 16*a*1_1; it being noted that conductive strip portions 16*a*1_1 is printed vertically over the portion 34 (FIGS. 3C, 3C') of strip conductive 16*b*2 (FIG. 3A) but separated by portions of the dielectric layer 32 (FIG. 3B) layer thereby forming the coupling section 18*a*; it being again noted that end portion 34*a* of the portion $\mathbf{16}b_2$ of the strip conductor 16*b*, remains uncovered by the dielectric layer 32.

Referring to FIGS. 3D, 3D', 3D" and 3D"', a dielectric layer 38 is 3D printed over the first coupling section 18*a* (FIGS. 3D and 3D"') leaving an outer edge 16*a*1_1*a* (FIGS. 3D', 3D" and 3D"')of conductive strip portion 16*a*1_1 exposed; it being remember that end portion 34*a* (FIGS. 3D' and 3D") of the portions $\mathbf{16}b_2$ (FIGS. 3D and 3D")of the strip conductor 16*b* remain uncovered by the dielectric layer 32.

Referring now to FIGS. 3E, 3E', 3E" conductive layer 20*a* is printed onto the top of dielectric layer 38 and over the sides (vertical edges of) the dielectric layers 32 and 38 onto the pads 30*a*, 30*b*, as shown in FIGS. 3E and 3E'.

Referring to FIGS. 3F, 3F' and 3F", a dielectric layer 40 is printed over portions of the conductive layer 20*a*, as shown.

Referring to FIGS. 3G, 3G', 3G" and 3G"', conductive layer 16*a*1_2 is printed onto the surface of dielectric layer 40 and over the outer, vertical edges of dielectric layers 38 and 40 and onto edge 16*a*1_1*a* to connect the conductive layer 16*a*1_1 to conductive layer 16*a*1_2.

Referring to FIGS. 3H, 3H', 3H" and 3H"', a dielectric layer 42 is printed over the conductive layer 16*a*1_2 and over the vertical side of such conductive layer 16*a*1_2, as shown in FIGS. 3H, 3H' and 3H". It is noted that end 16*a*1_2*a* of strip 16*a*1_2 is left exposed as shown in FIG. 3H.

Referring to FIGS. 3I, 3I', 3I", and 3I"', a conductive strip 16*b*2_1 is printed over dielectric 42 and aligned vertically over conductive strip 16*a*1_2 (FIGS. 3H, 3H' and 3H") to form the second coupling section 18*b*; it being noted that such conductive material 16*b*2_1 is printed over the portions of the dielectric layer both on the upper surface and side of the structure shown in FIG. 3I"' with a portion of the conductive strip 16*b*2_1 being printed on the edge portion 34*a* of the portion 34 of strip conductor 16*b*2 thereby connecting strip conductor 16*b*2_1 strip conductor 16*b*2 serially connecting coupling section 18*a* to coupling section 18*b*. It is noted that an end of strip conductor 16*a*2_1 remains exposed by both the strip conductor 16*b*2_1 and the dielectric layer 42.

Referring to FIGS. 3J, 3J', 3J", and 3J"', a dielectric layer 44 is printed to fill a space 45 (FIG. 3I) on the surface next to previously printed sections of substrate 12, as shown. This dielectric layer 44 (FIGS. 3J', 3J" and 3J"')should be printed to same height of the dielectric layers next to it to form a level dielectric surface for subsequent processing of the coupling region.

Referring to FIGS. 3K, 3K', 3K" and 3K"', a dielectric layer 46 (FIG. 3K, 3K',3K") is printed on the structure shown in FIG. 3J thus formed leaving ends 16*a*1_2*a* and 16*b*2_1*a* (FIGS. 3K, 3K") of strip conductors 16*a*1_2 and 16*b*2_1, respectively, exposed, as shown.

Referring to FIGS. 3L, 3L' and 3L", the conductive layer 20*b* is printed on top of the middle portion of dielectric layer 46, as shown in FIGS. 3L and 3L".

Referring to FIGS. 3M, 3M' and 3M", a dielectric layer 48 is printed on the surface of the structure shown in FIG. 3L thus formed over conductive layer 20*b* (FIGS. 3M, 3M'), as shown.

Referring to FIGS. 3N, 3N, 3N" and 3N"', a conductive strip 16*b*1_2 is printed on the end of strip conductor 16*b*1, (FIG. 3N) up and along the sides of dielectric layers 44, 46 and 48 along the upper surface of dielectric layer 48 and then down the sides of dielectric layers 48 and 46 to connect with the end 16*b*2_1*a* of strip conductor 16*b*2_1, as shown.

Referring to FIGS. 3O, 3O' and 3O", a dielectric layer 50 (FIGS. 3O' and 3O") is printed on top of the structure shown in FIG. 3N over the portion of strip conductor 16*b*1_2 on the upper surface of dielectric layer 48 and over the portion of the strip conductor 6*b*2_1 along the sides of dielectric layers 48 and 46, as shown.

Referring to FIGS. 3P, 3P', 3P' and 3P", a conductive strip 16*a*1_3 (FIG. 3P"') is printed on the edge 16*a*1_2*a* (FIG. 3P") of strip conductor 16*a*1_2, along the vertical sides of dielectric layer 50 along the upper, horizontal surface of dielectric layer 50 vertically aligned over the strip conductor 16*b*2_1 on the surface of dielectric layer 48, forming the third coupling section 18*c*, and then down the sides of dielectric layers 50, 48, 46 and 44 to connect with the end of strip conductor 16*a*2 which is on the surface of the substrate 12, as shown.

Referring to FIGS. 3Q, 3Q', 3Q" and 3Q'", a dielectric layer 52 (FIG. 3Q") is printed to fill space 51 (FIG. 3P'") to provide a level surface as across the coupling region being formed, as shown.

Referring to FIGS. 3R, 3R', 3R", and 3R'", dielectric layer 54 is printed as shown to cover both the horizontal portion and vertical portion of the strip conductor 16*a*1_3 on the top and vertical sides of the structure shown in FIG. 3Q while exposing strip conductors 16*a*1, 16*b*1, 16*a*2 and 16*b*2, as shown in FIG. 3R.

Referring to FIGS. 3S, 3S', 3S" and 3S'", the conductive layer 20*c* is printed on the upper surface and vertical sides of the structure as shown in FIG. 3S and onto conductive pads 30*c* (FIGS. 3S, 3S', 3S" and 3S'") and 30*d*, (FIG. 3S) as shown.

Referring now to FIGS. 3T, 3T' 3T" and 3T'", a conductive layer 20*d* is printed on the upper surface of and a pair of opposing sides of the structure shown in FIG. 3S and onto conductive pads 30*a* and 30*b* and onto edges of layers 20*a*, 20*b*, connecting to conductive pads 30*a*, 30*b*, as shown thereby completing shield for the coupling region 18 for the structure 10. It is noted that the conductive pads 30*a*-30*d* may be connected to the ground plane by conductive vias 31, passing through the substrate or by printing a conductor around sides of the substrate between the conductive pads 30*a*-30*d* and the ground plane. It is also noted that the conductive layers are here printed with any suitable conductive ink and the dielectric layers may be printed with any suitable dielectric ink.

Referring now to FIGS. 5A-5D; here an RF coupler 14' is shown according to another embodiment of the disclosure formed using the same 3D printing or additive manufacturing techniques described above. Here, the electromagnetic coupling region 18' includes a plurality, here for example, three electromagnetic coupling sections 18*a*, 18*b*' and 18*c*'. More particularly, electromagnetic coupling region 18' comprises a plurality of, here for example three, serially connected, vertically stacked, coupling sections 18*a*', 18*b*', and 18*c*'. Here, each one of the coupling sections 18*a*', 18*b*' and 18*c*' includes adjacent portions of the pair of strip conductors 16*a*', 16*b*', having portions thereof disposed in a side-by-side relationship in a horizontal plane in each of the coupling sections. Again, the portions of the strip conductors 16*a*, 16*b* in each pair in the coupling sections 18*a*', 18*b*' and 18*c*' are separated by a dielectric gap, G', here the gap G' is disposed in a horizontal, the gap, G', in the forming an electromagnetic coupling region between the adjacent portions of the pair of strip conductors 16*a*, 16*b*.

Further, as described above in connection with the RF coupler 10 (FIG. 2A), the RF coupler 10' includes two, horizontally disposed, electrically conductive layers 20*a*, 20*b*, each one of the electrically conductive layers 20*a* and 20*c* being disposed between a corresponding pair of the vertically stacked coupling sections 18*a*', 18*b*' and 18*c*', as shown. More particularly, conductive layer 20*a* is disposed between coupling sections 18*a*' and 18*b*' and conductive layer 20*b* is disposed between coupling sections 18*b*' and 18*c*'. An electrically conductive layer 20*c* and 20*d* provides an upper or top cover for the RF coupler 14', and electrically conductive layer 20*d* provides sides for the RF coupler 14'; it being noted that the electrically conductive layers 20*a*-20*d* are electrically interconnected one to the other and are electrically connected to conductive pads 30*a*-30*d*; such conductive pads 30*a*-30*d* being electrically connected to the ground plane conductor 13 by electrically conductive vias 31 passing vertically through the substrate 12 FIG. 2A to provide the electrostatically conductive shield 22 around the coupling sections 18*a*'-18*c*' as described in FIG. 2A.

Figure 5C:
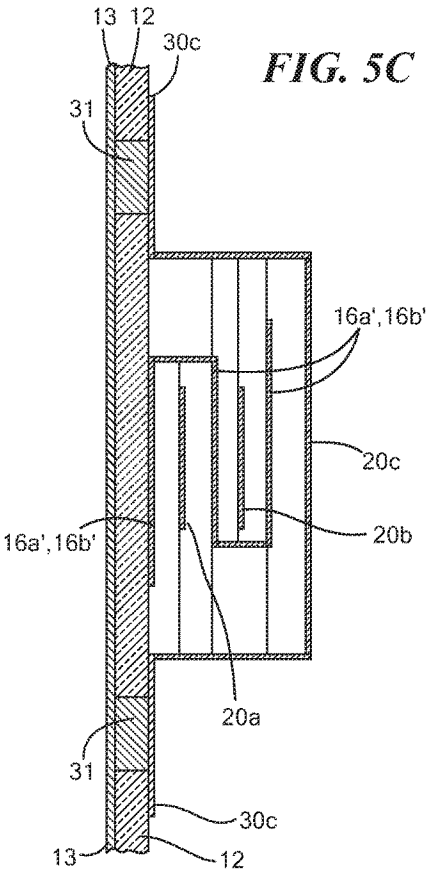
FIGS. 5A-5D are plane, cross-sectional and perspective view sketches of an RF coupler according to another embodiment of the disclosure.
Figure 5B:
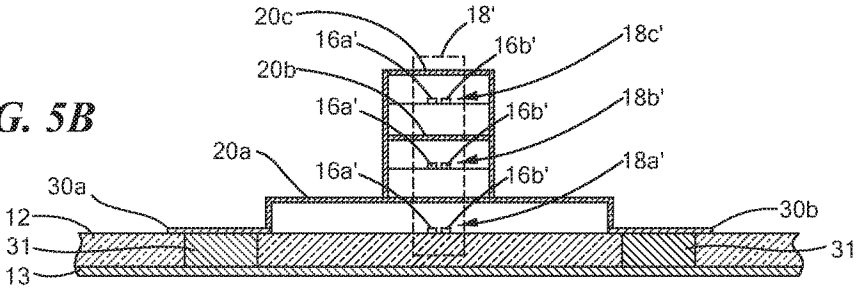
Figure 5A:
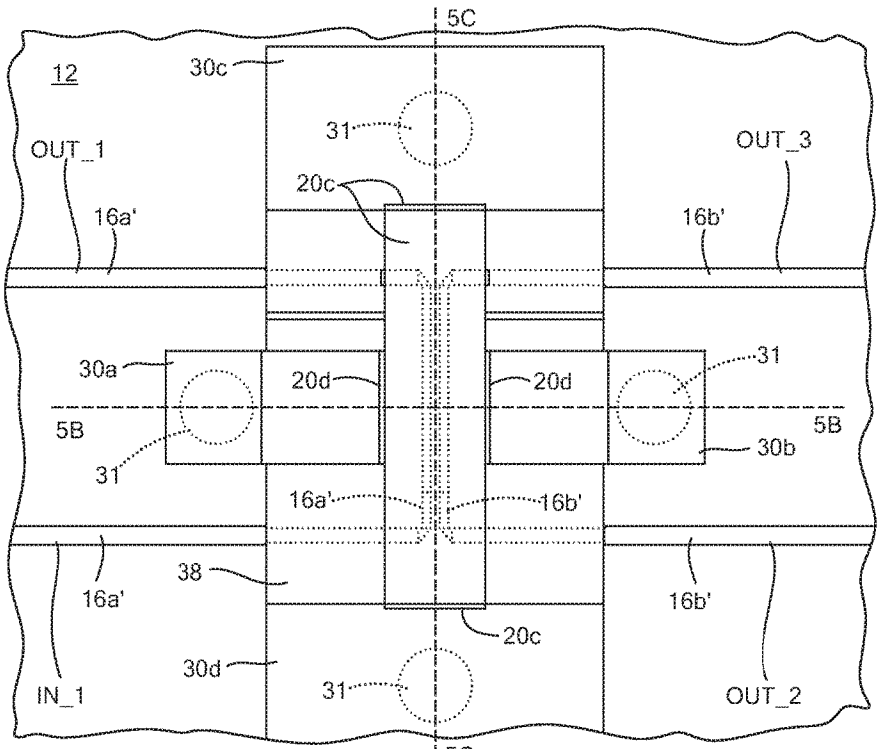
Figure 5D:
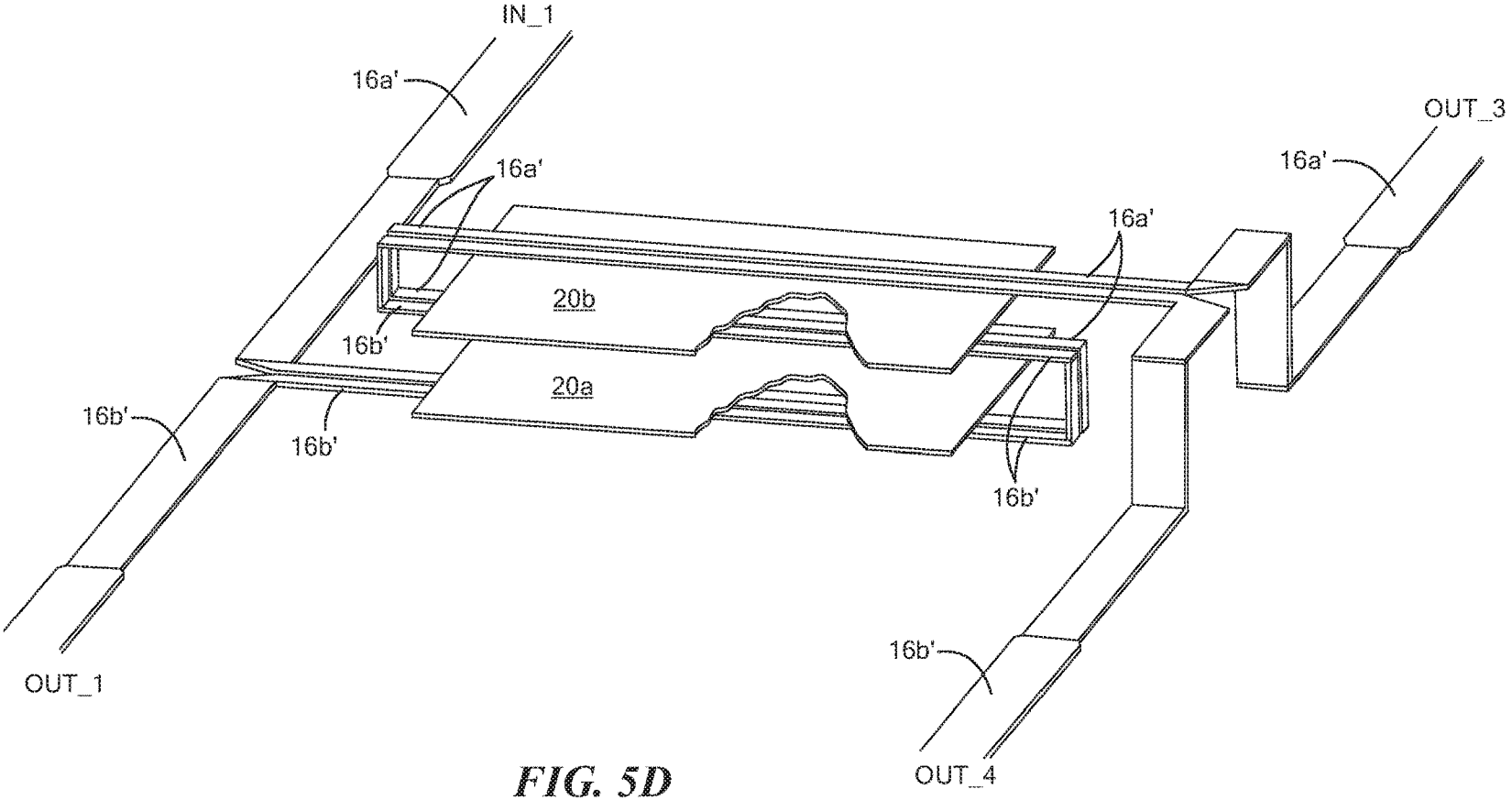
Figure 5B:
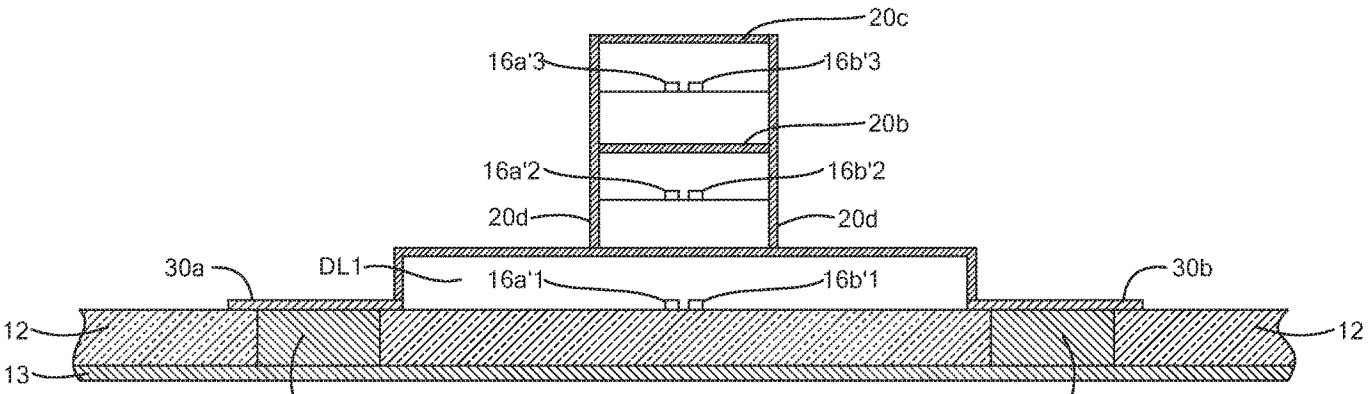
Figure 5C:
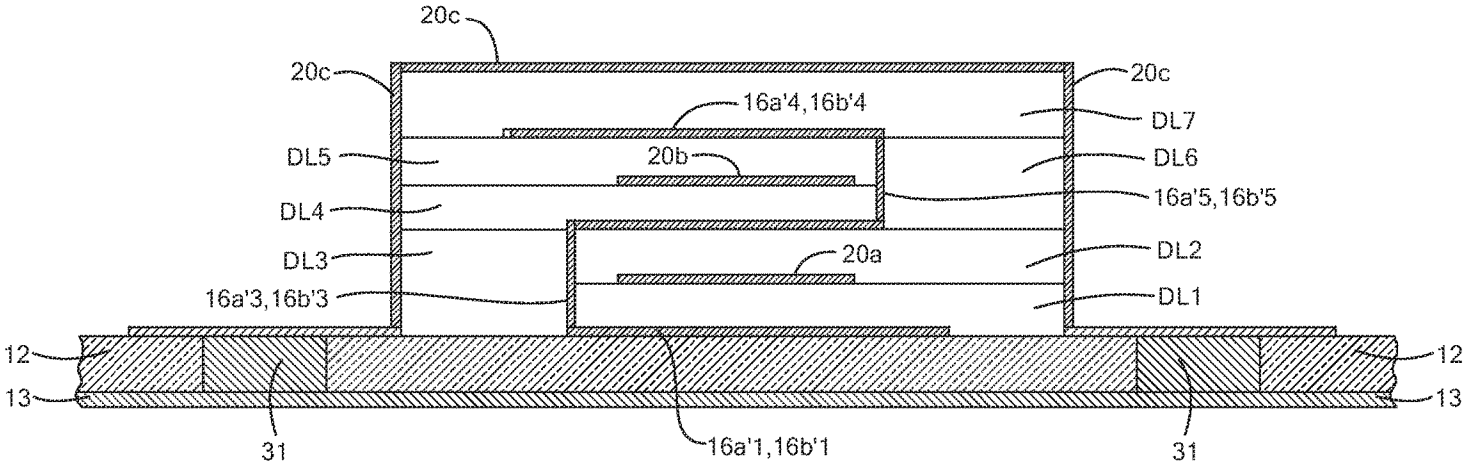

Still more particularly, and referring to FIGS. 5B' and 5C', the strip conductor 16*a*' includes serially connected conductive layers 16*a*'1, 16*a*'2, 16*a*'3, 16*a*'4 and 16*a*'5 and strip conductor 16*b*' includes serially connected conductive layers 16*b*'1, 16*b*'2, 16*b*'3, 16*b*'4, and 16*b*'5. Thus, the coupler 10' is formed by 3D printing or additive manufacture by the following material deposition sequence: Strip conductor layers 16'*a*1 and 16*b*'1; dielectric layer DL1; conductive layer 20*a*; dielectric layer DL2; strip conductors layers 16'*a*2, 16*b*'2; strip conductor layers 16*a*'3, 16*b*'3 (connecting strip conductors layers 16'*a*1, 16*b*'1 to strip conductor layers 16*a*'2, 16*b*'2, respectively); dielectric layer DL 3; dielectric layer DL4; conductive layer 20*b*; dielectric layer DL5; strip conductor layers 16*a*'4, 16*b*'4; strip conductor layers 16*a*'5, 16*b*'5 (connecting strip conductor layers 16*a*'4, 16*b*'4 to strip conductor layers 16*a*'2, 16*b*'2, respectively); dielectric layer DL6; dielectric layer DL-7; conductive layer 20*c*; and conductive layer 20*d* (connecting conductive layers 20*a*, 20*b* and 20*c* and also connecting such conductive layers 20*a*, 20*b* and 20*c* to the ground plane conductor 13 through the conductive vias 31).

A number of embodiments of the disclosure have been described. Nevertheless, it will be understood that various modifications may be made without departing from the spirit and scope of the disclosure. For example, while three levels of coupling regions 18*a*-18*c* have been described, the number of coupling sections may be two or more than three. Further, multi-material printing options using multiple printing heads may be used reducing the number of printing steps. Accordingly, other embodiments are within the scope of the following claims.

What is claimed is:

1. An RF coupler, comprising:

a plurality of electrically connected, vertically stacked, coupling sections, each one of the coupling sections comprising:

a pair of dielectrically separated strip conductors disposed in an inner region of the electrically connected, vertically stacked, coupling sections, each one of the strip conductors being disposed in a horizontal plane and separated by an electromagnetic coupling region disposed between the pair of strip conductors, a first one of the pair of dielectrically separated strip conductors being disposed over a second one of the dielectrically separated strip conductors;

an electrically conductive interconnecting layer disposed on an outer region of the electrically connected, vertically stacked, coupling section and passing vertically between an end of a first one of the pair of dielectrically separated strip conductors of the coupling section to an end of a second one of the pair of dielectrically separated strip conductors of another one of the coupling sections electrically interconnecting the pair dielectrically separated strip conductors; and a dielectric structure, disposed between the pair of dielectrically separated strip conductors, having an end disposed on an inner surface of the electrically conductive interconnecting layer disposed on the outer region of the plurality of electrically connected, vertically stacked, coupling sections.

2. An RF coupler, comprising:

a plurality of electrically connected, vertically stacked, coupling sections, each one of the coupling sections comprising:

a pair of dielectrically separated strip conductors, the strip conductors being separated by an electromagnetic coupling region disposed between the pair of strip conductors;

a plurality of electrically conductive layers, each one of the electrically conductive layers being disposed between a pair of the vertically stacked coupling sections; and an electric shield disposed over top and sides of the coupling sections;

a solid dielectric structure disposed between the plurality of electrically connected, vertically stacked, coupling sections and the electric shield; and wherein the dielectric structure comprises:

a plurality of dielectric layers, at least one of the dielectric layers having a horizontal portion and a vertical portion, the vertical portion being disposed at an end of the horizontal portion;

wherein each one of the plurality of dielectric layers is disposed over at least one electromagnetic coupling region; and wherein the vertical portion of the at least one of the plurality of dielectric layers being disposed between a corresponding one of the plurality of vertically stacked, coupling sections layers and a corresponding portion of an inside surface of the electric shield.

3. The RF coupler recited in claim 2 wherein the vertical portion of the at least one of the plurality of dielectric is a continuous layer.

4. The RF coupler recited in claim 2 wherein the electric shield comprises electrically connected portions of a second plurality of electrically conductive layers.

5. The RF coupler recited in claim 4 including a third plurality of connected electrically conductive layers disposed between adjacent pairs of the horizontal portion of the dielectric layers.

6. An RF coupler, comprising:

a plurality of electrically connected, vertically stacked, coupling sections, each one of the coupling sections comprising:

a pair of dielectrically separated strip conductors, the strip conductors being separated by an electromagnetic coupling region disposed between the pair of strip conductors;

an electrically conductive layer disposed between the pair of dielectrically separated strip conductors of one of the coupling sections and the pair of dielectrically separated strip conductors of another one of the coupling sections;

a pair of vertically disposed dielectric layers, the electrically conductive layer being disposed between the pair of dielectrically separated strip conductors;

wherein the pair of vertically disposed dielectric layers comprises a dielectric ink; and wherein an end portion of one of the pair of vertically disposed dielectric layers is disposed on an end portion of one of the pair of dielectrically separated strip conductors of one of the coupling sections.

7. The RF coupler recited in claim 6 including an electric shield disposed over top and sides of the plurality of electrically connected, vertically stacked, coupling sections and wherein the pair of vertically disposed dielectric layers is disposed on the electric shield.

8. The RF coupler recited in claim 7 wherein the electric shield comprises a conductive ink.

9. The RF coupler recited in claim 8 wherein the pair of dielectrically separated strip conductors comprise a conductive ink.

10. The RF coupler recited in claim 7 wherein the pair of dielectrically separated strip conductors comprise a conductive ink.

11. The RF coupler recited in claim 6 wherein the pair of dielectrically separated strip conductors comprise a conductive ink.

12. An RF coupler, comprising:

a plurality of serially connected, vertically stacked, coupling sections, each one of the coupling sections comprising:

a pair of strip conductors separated by an electromagnetic coupling region between the pair of strip conductors; and wherein the pair of strip conductors in one of the coupling sections is electrically connected to the pair of strip conductors in another one of coupling sections;

wherein the pair of strip conductors in one of the coupling sections is disposed in an overlaying, vertical relationship with the pair of strip conductors in another one of coupling sections; and an electric shield disposed over top and sides of the plurality of serially connected, vertically stacked, coupling sections;

a solid dielectric structure disposed between the plurality of serially connected, vertically stacked, coupling sections and the electric shield; and wherein the solid dielectric structure, comprises:

a plurality of dielectric layers, at least one the dielectric layers having a horizontal portion and a vertical portion, the vertical portion being disposed at an end of the horizontal portion;

wherein each one of the plurality of dielectric layers is disposed over at least one electromagnetic coupling region; and wherein the vertical portion of the at least one of the plurality of dielectric layers is disposed between a corresponding one of the plurality of vertically stacked, coupling sections layers and a corresponding portion of an inside surface of the electric shield.

13. The RF coupler recited in claim 12 wherein the at least one of the dielectric layers having the horizontal portion and a vertical portion is a single continuous layer.

* * * * *